US008668597B2

(12) United States Patent
Yamamoto

(10) Patent No.: US 8,668,597 B2
(45) Date of Patent: Mar. 11, 2014

(54) GOLF CLUB

(75) Inventor: Akio Yamamoto, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 289 days.

(21) Appl. No.: 12/912,282

(22) Filed: Oct. 26, 2010

(65) Prior Publication Data

US 2011/0098127 A1 Apr. 28, 2011

(30) Foreign Application Priority Data

Oct. 27, 2009 (JP) ..... 2009-246017

(51) Int. Cl.
*A63B 53/02* (2006.01)

(52) U.S. Cl.
USPC ..... 473/307; 473/288; 473/246; 473/309

(58) Field of Classification Search
USPC ..... 473/288, 307, 244–248, 309
See application file for complete search history.

(56) References Cited

U.S. PATENT DOCUMENTS

| | | | | |
|---|---|---|---|---|
| 651,920 | A * | 6/1900 | Cushing | 473/245 |
| 2,027,452 | A * | 1/1936 | Rusing | 473/246 |
| 4,948,132 | A * | 8/1990 | Wharton | 473/246 |
| 7,566,279 | B2 * | 7/2009 | Nakashima | 473/288 |
| 7,704,156 | B2 * | 4/2010 | Stites et al. | 473/246 |
| 7,874,934 | B2 * | 1/2011 | Soracco et al. | 473/307 |
| 7,997,997 | B2 * | 8/2011 | Bennett et al. | 473/288 |
| 8,025,587 | B2 * | 9/2011 | Beach et al. | 473/245 |
| 8,096,894 | B2 * | 1/2012 | Sander | 473/288 |
| 2006/0293115 | A1 | 12/2006 | Hocknell et al. | |
| 2008/0293510 | A1 | 11/2008 | Yamamoto | |
| 2009/0011848 | A1 | 1/2009 | Thomas et al. | |

FOREIGN PATENT DOCUMENTS

JP 2006-42951 A 2/2006

* cited by examiner

*Primary Examiner* — Stephen L. Blau
(74) *Attorney, Agent, or Firm* — Birch, Stewart, Kolasch & Birch, LLP

(57) ABSTRACT

A golf club 2 is provided with a head 4, a shaft 6, a tip member 8, and a screw member 10. The shaft 6 is inserted into a shaft hole of the tip member 8, and a tip part of the shaft 6 is fixed to the shaft hole. An axis line s1 of the shaft 6 is inclined with respect to an axis line z1 of the tip member 8. The head 4 has a head hole into which the tip member is inserted, a head side engaging part capable of being engaged with the tip member 8 inserted into the head hole, and a through hole into which the screw member 10 can be inserted. The tip member 8 has a shaft side engaging part 38 capable of being engaged with the head side engaging part. Circumferential relative positions A in which the head side engaging part and the shaft side engaging part can be engaged with each other are M kinds. The circumferential relative positions A can equalize adjustment distance of a loft angle, a lie angle, or a hook angle as compared with circumferential relative positions B in being equally divided into M pieces in a circumferential direction.

3 Claims, 28 Drawing Sheets

(CS45)

(CS90)

(CS135)

(CS180)

GOLF CLUB

This application claims priority on Patent Application No. 2009-246017 filed in JAPAN on Oct. 27, 2009, the entire contents of which are hereby incorporated by reference.

BACKGROUND OF THE INVENTION

1. Field of the Invention

The present invention relates to a golf club. In particular, the present invention relates to a golf club allowing a shaft to be attached to/detached from a head.

2. Description of the Related Art

A golf club allowing a shaft to be attached to/detached from a head has been proposed. Easiness in attaching/detaching a shaft to/from a head is useful for several reasons. If attaching/detaching of a shaft to/from a head is easy, golf players themselves can change the head and the shaft easily. For example, golf players who cannot be satisfied with the performance of the purchased golf club easily can change the head and the shaft by themselves. The golf players themselves can easily assemble an original golf club in which a favorite head and a favorite shaft are combined. The golf players can purchase the favorite head and the favorite shaft, and can assemble the head and the shaft by themselves. Stores which sell the golf clubs can select the combination of the head and the shaft corresponding to qualifications of the golf player, and sell the combination. The head and the shaft detachably attached facilitate the custom-made golf club.

The golf club is also suitable in the evaluation of the head or the shaft. For example, when the comparative test of three kinds of shafts is performed, a highly precise comparative test can be performed by mounting the same kind of head to three kinds of shafts. When different heads are mounted to the same shaft, a comparative test of the head can be performed with high precision.

U.S. Patent Application No. 2009/0011848 A1, U.S. Patent Application No. 2006/0293115 A1, Japanese Patent Application Laid-Open No. 2008-284289 (U.S. Patent Application No. 2008/293510), and Japanese Patent Application Laid-Open No. 2006-42951 disclose a structure in which a shaft is easily attached to/detached from a head. FIGS. 9A and 9B or the like of U.S. Patent Application No. 2009/0011848 A1 disclose a golf club capable of adjusting an angle of a shaft to a head.

SUMMARY OF THE INVENTION

It was found that there is room for improvement in adjustment of a shaft angle in the conventional technique.

It is an object of the present invention to provide a golf club capable of facilitating adjustment of specifications due to the shaft angle.

A golf club according to a first aspect includes a head, a shaft, a tip member, and a screw member. The tip member has a shaft hole and a screw hole. The shaft is inserted into the shaft hole of the tip member, and a tip part of the shaft is fixed to the shaft hole. An axis line s1 of the shaft is inclined to an axis line z1 of the tip member. The head has a head hole into which the tip member is inserted, a head side engaging part capable of being engaged with the tip member inserted into the head hole, and a through hole into which the screw member can be inserted. The tip member has a shaft side engaging part capable of being engaged with the head side engaging part. The head side engaging part and the shaft side engaging part are engaged with each other so that relative rotation of the head and the tip member is regulated. Coming off of the tip member from the head is regulated by screw connection of the screw member inserted into the through hole and the screw hole. Circumferential relative positions A in which the head side engaging part and the shaft side engaging part can be engaged with each other are M kinds (M is an integer of equal to or greater than 3). The M kinds of circumferential relative positions A can adjust a loft angle, a lie angle, or a hook angle (face angle). The circumferential relative positions A can equalize adjustment distance of the loft angle, the lie angle, or the hook angle as compared with circumferential relative positions B in being equally divided into M pieces in a circumferential direction.

Preferably, when a maximum value of the hook angle is defined as Fmax; a minimum value of the hook angle is defined as Fmin; and a value calculated by an expression [(Fmax+Fmin)/2] is defined as Fmid, a circumferential relative position enabling adjustment to a hook angle Fa satisfying the following expression (1), and a circumferential relative position enabling adjustment to a hook angle Fb satisfying the following expression (2) exist in the circumferential relative positions A:

$$Fmid+(Fmax-Fmid)\times 0.4 \leq (Fmax-Fmid)\times 0.6 \quad (1); \text{ and}$$

$$Fmin+(Fmid-Fmin)\times 0.4 \leq (Fmid-Fmin)\times 0.6 \quad (2).$$

Preferably, a maximum value of the adjustment distance of the hook angle is equal to or less than 1.5 degrees.

A golf club according to a second aspect includes a head, a shaft, a tip member, and a screw member. The tip member has a shaft hole and a screw hole. The shaft is inserted into the shaft hole of the tip member, and a tip part of the shaft is fixed to the shaft hole. An axis line s1 of the shaft is inclined to an axis line z1 of the tip member. The head has a head hole into which the tip member is inserted, a head side engaging part capable of being engaged with the tip member inserted into the head hole, and a through hole into which the screw member can be inserted. The tip member has a shaft side engaging part capable of being engaged with the head side engaging part. The head side engaging part and the shaft side engaging part are engaged with each other so that relative rotation of the head and the tip member is regulated. Coming off of the tip member from the head is regulated by screw connection of the screw member inserted into the through hole and the screw hole. Circumferential relative positions A in which the head side engaging part and the shaft side engaging part can be engaged with each other are N kinds. The N kinds of circumferential relative positions A can adjust a loft angle, a lie angle, or a hook angle. A key indication corresponding to X kinds (X is an integer of less than N) of circumferential relative positions C, of the N kinds of circumferential relative positions A is provided. The circumferential relative positions C can equalize adjustment distance of the loft angle, the lie angle, or the hook angle as compared with circumferential relative positions D in being equally divided into X pieces in a circumferential direction.

Preferably, when a maximum value of the hook angle is defined as Fmax; a minimum value of the hook angle is defined as Fmin; and a value calculated by an expression [(Fmax+Fmin)/2] is defined as Fmid, a circumferential relative position enabling adjustment to a hook angle Fa satisfying the following expression (1), and a circumferential relative position enabling adjustment to a hook angle Fb satisfying the following expression (2) exist in the circumferential relative positions C:

$$Fmid+(Fmax-Fmid)\times 0.4 \leq Fa \leq Fmid+(Fmax-Fmid)\times 0.6 \quad (1); \text{ and}$$

$$Fmin+(Fmid-Fmin)\times 0.4 \leq Fb \leq Fmin+(Fmid-Fmin)\times 0.6 \quad (2).$$

Preferably, a maximum value of the adjustment distance of the hook angle based on the key indication is equal to or less than 1.5 degrees.

DESCRIPTION OF THE PREFERRED EMBODIMENTS

The present invention will be described below in detail based on preferred embodiments with reference to the drawings.

In the present application, a circumferential relative position A, a circumferential relative position B, a circumferential relative position C, and a circumferential relative position D are described. These meanings are as follows.

Circumferential relative position A: A fixable circumferential relative position, that is, an adjustable circumferential relative position.

Circumferential relative position B: A circumferential relative position in being equally distributed in a circumferential direction.

Circumferential relative position C: A circumferential relative position corresponding to a key indication (to be described later).

Circumferential relative position D: A circumferential relative position in being equally distributed in a circumferential direction.

The number of the circumferential relative positions A is M or N. The number of the circumferential relative positions B is M as in the circumferential relative position A. The number of the circumferential relative positions C is X. The number of the circumferential relative positions D is X. M, N and X are integers. X is smaller than N.

Figure 1:
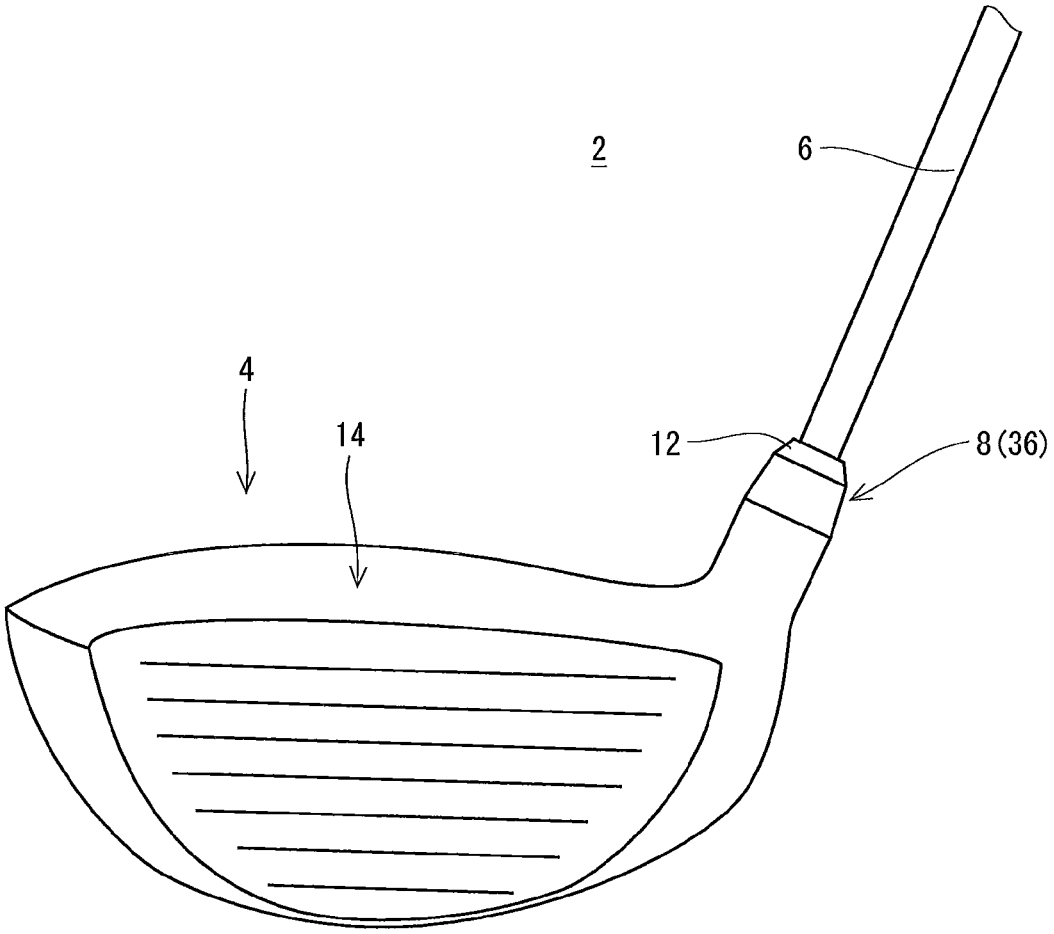
FIG. 1 is a diagram showing a golf club according to a first embodiment of the present invention.
Figure 2:
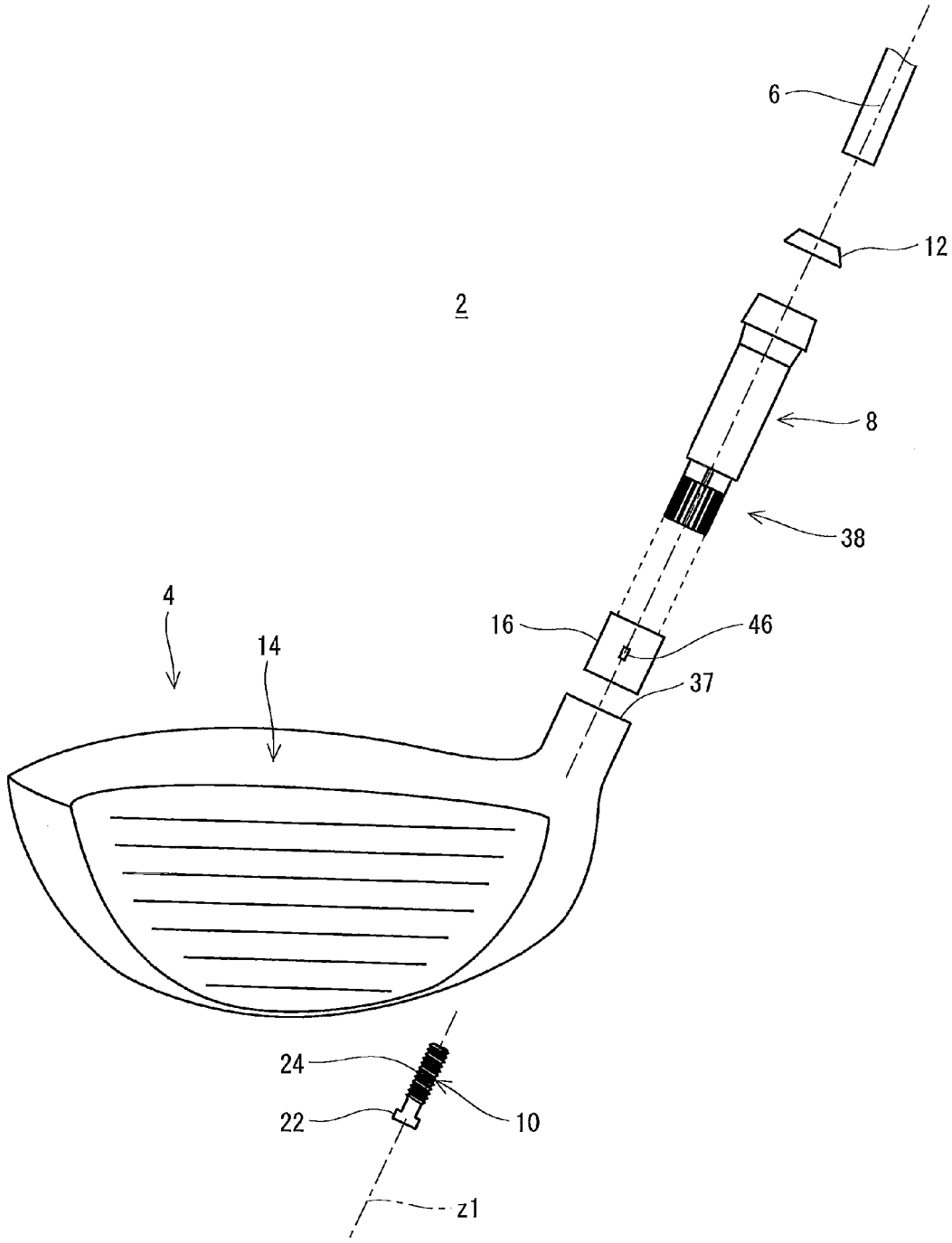
FIG. 2 is an exploded view of FIG. 1.
Figure 3:
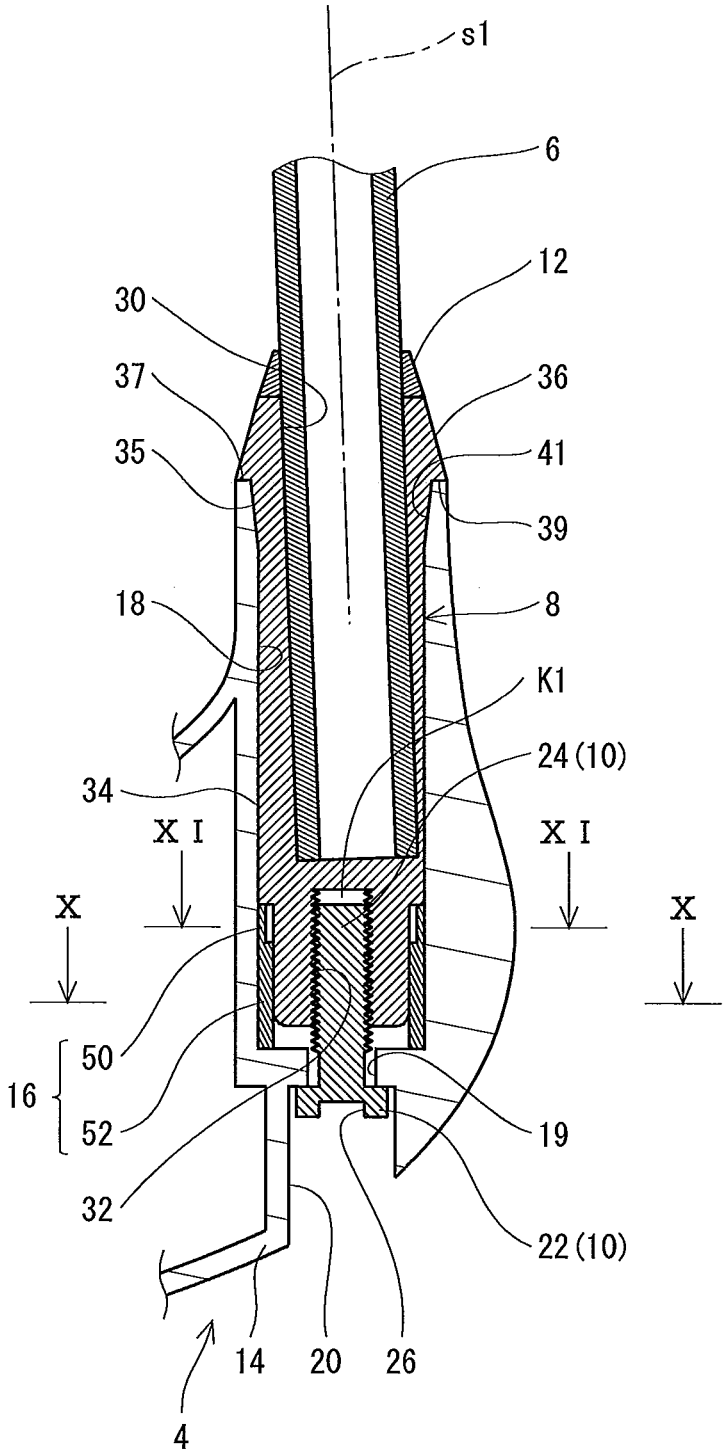
FIG. 3 is a cross sectional view of FIG. 1.

FIG. 1 shows a golf club 2 according to a first embodiment of the present invention. FIG. 1 shows only a vicinity of a head of the golf club 2. FIG. 2 is an exploded view of the golf club 2. FIG. 3 is a cross sectional view of the golf club 2. FIG. 3 is a cross sectional view taken along a center axis line of a tip member 8.

The golf club 2 has a head 4, a shaft 6, a tip member 8, a screw member 10, and a ferrule 12. The tip member 8 is fixed to a tip of the shaft 6. A grip (not shown) is mounted to a butt end of the shaft 6.

The head 4 has a head body 14 and an engaging member 16. The head body 14 has a head hole 18 into which the tip member 8 is inserted, and a through hole 19 into which the screw member 10 is inserted. The through hole 19 passes through a bottom part of the head hole 18. The head body 14 has a sole hole 20 opened to a sole (see FIG. 3). The sole hole 20 and the head hole 18 are continued through the through hole 19.

The type of the head 4 is not restricted. The head 4 of the embodiment is a wood type golf club. A utility type head, a hybrid type head, an iron type head, a putter head, or the like can be also used.

The shaft 6 is not restricted. A generalized carbon shaft, steel shaft, or the like can be used.

The screw member 10 has a head part 22 and a screw part 24 (see FIG. 2). The screw member 10 passes through the through hole 19 from the sole hole 20 to a screw hole 32 (to be described later). The screw part 24 is connected to the tip member 8 in a screwing manner (to be described in detail later). The head part 22 has a concave part 26 for a hexagonal wrench (see FIG. 3). The screw member 10 located in the head body 14 can be axially rotated by using the hexagonal wrench fitted into the concave part 26. This axial rotation enables attachment and detachment of the tip member 8.

The engaging member 16 is fixed to the head body 14 (see FIG. 3). The fixing method is not restricted. As the fixing method, bonding, welding, fitting and a combination thereof are exemplified. The engaging member 16 is put into the head hole 18 from an upper side opening of the head hole 18. The engaging member 16 is fixed to the bottom part of the head hole 18.

The engaging member 16 has a head side engaging part. The head side engaging part will be described later.

Figure 4:
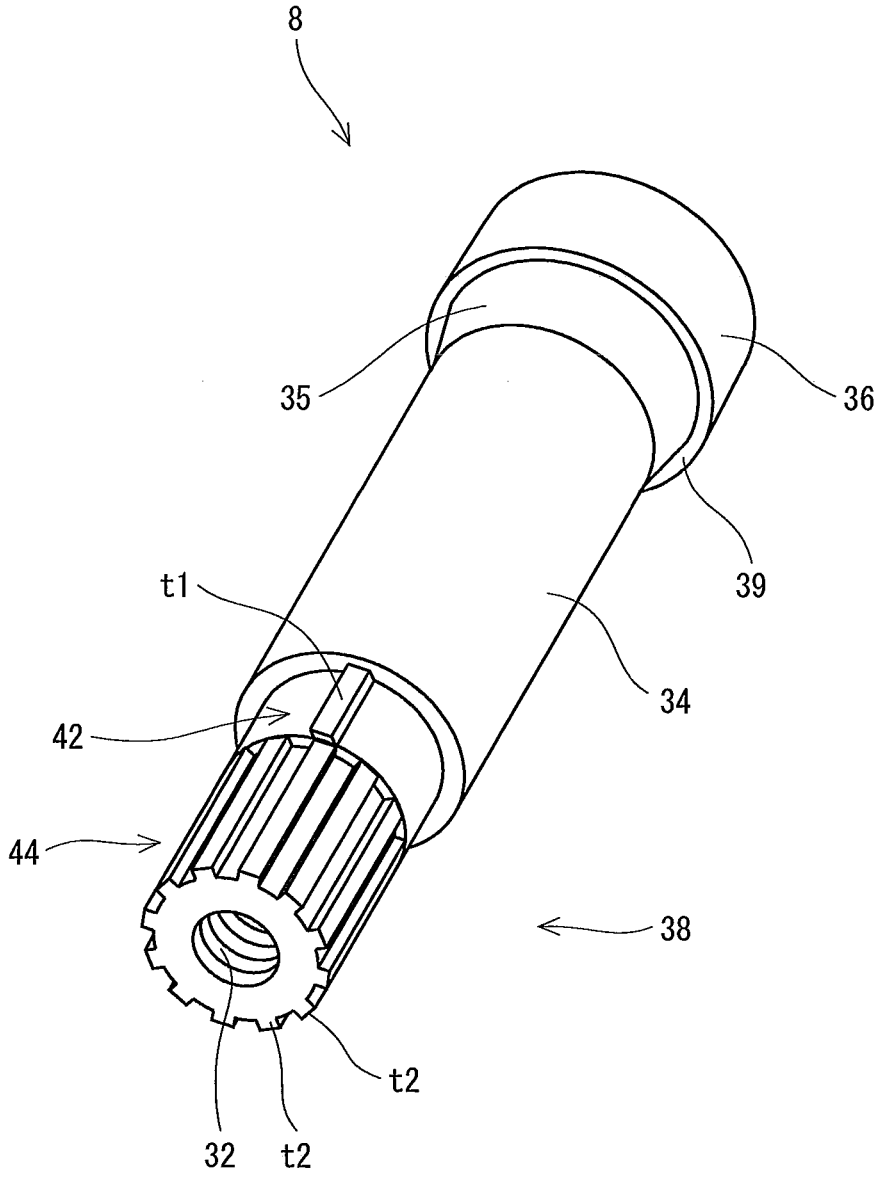
FIG. 4 is a perspective view of a tip member according to the first embodiment.
Figure 5:
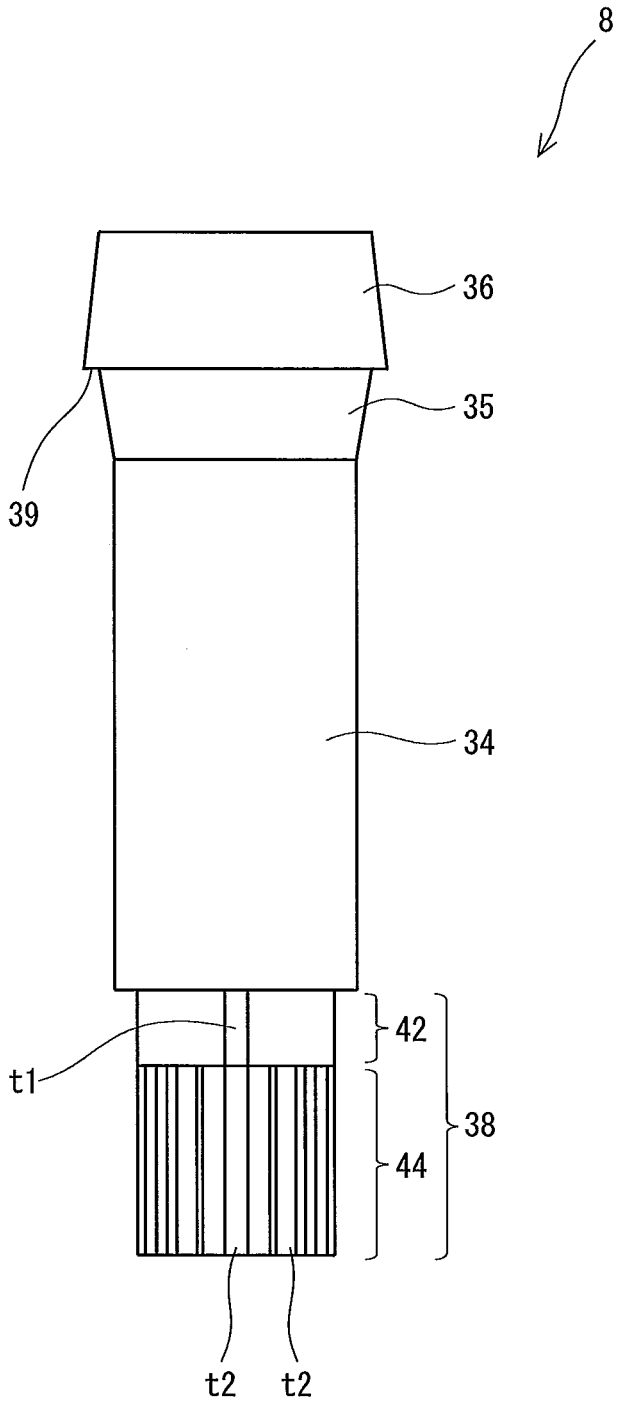
FIG. 5 is a side view of the tip member of FIG. 4.
Figure 6:
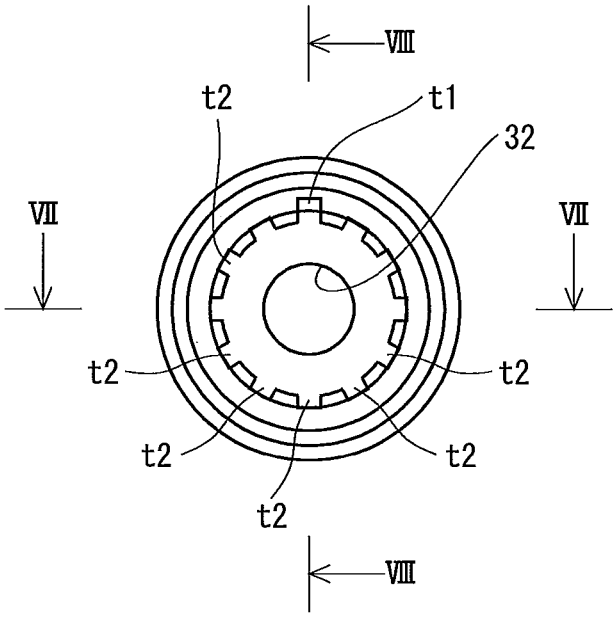
FIG. 6 is a bottom view of the tip member of FIG. 4.
Figure 7:
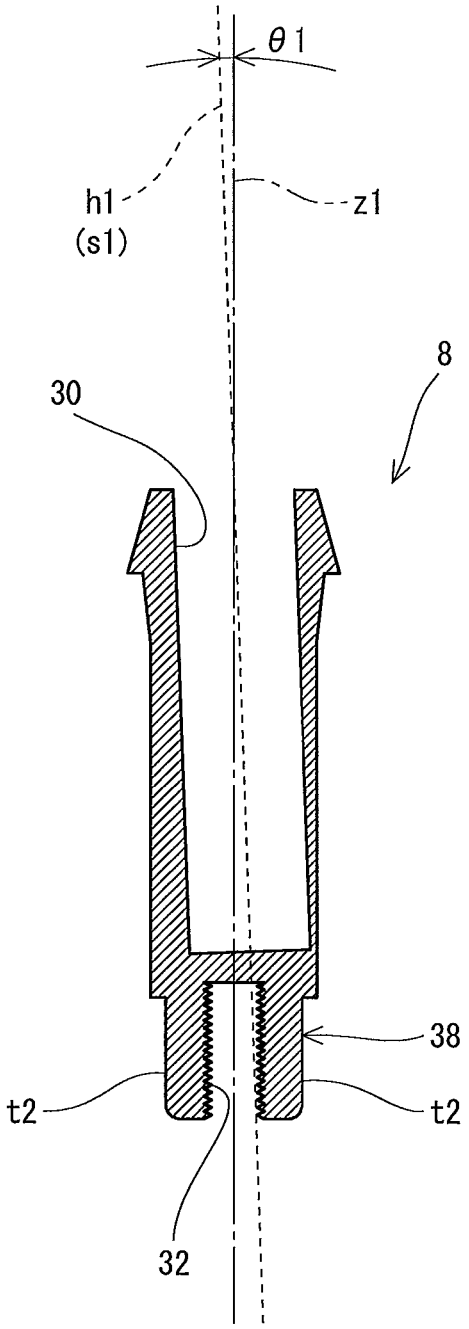
FIG. 7 is across sectional view taken along a line VII-VII of FIG. 6.
Figure 8:
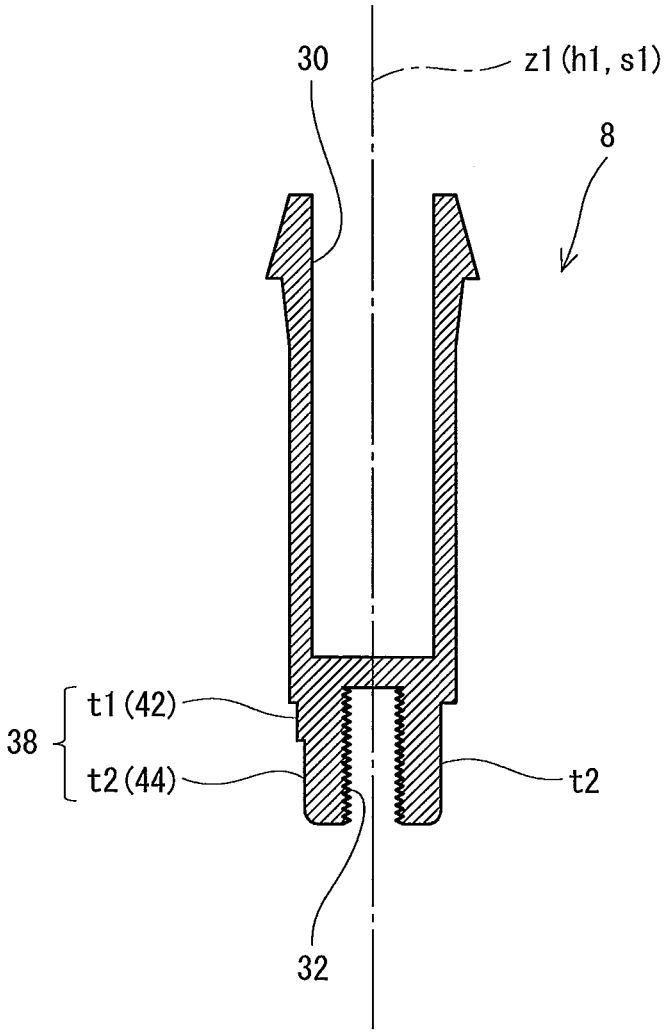
FIG. 8 is a cross sectional view taken along a line VIII-VIII of FIG. 6.

FIG. 4 is a perspective view of the tip member 8. FIG. 5 is a side view of the tip member 8. FIG. 6 is a bottom view of the tip member 8. FIG. 7 is a cross sectional view taken along a line VII-VII of FIG. 6. FIG. 8 is a cross sectional view taken along a line VIII-VIII of FIG. 6.

The tip member 8 has a shaft hole 30 and the screw hole 32 (FIGS. 7 and 8). The shaft hole 30 is opened to one side (an upper side). The screw hole 32 is opened to the other side (a lower side). The screw hole 32 is disposed on the lower side of the shaft hole 30.

The tip member 8 further has a definite-diameter circumferential surface 34, an inclined surface 35, an exposed surface 36 and a shaft side engaging part 38. The definite-diameter circumferential surface 34 is a portion with a fixed outer diameter. A bump surface 39 exists on the lower end of the exposed surface 36.

In a shaft mounting state (see FIGS. 1 and 3), the exposed surface 36 is exposed to the outside. An outer diameter of a lower end of the exposed surface 36 is substantially equal to an outer diameter of a hosel end face 37. An outer diameter of an upper end of the exposed surface 36 is substantially equal to an outer diameter of a lower end of the ferrule 12. The exposed surface 36 and the ferrule 12 look like a conventional ferrule. The exposed surface 36 enhances appearance.

The tip member 8 below the exposed surface 36 is inserted into the head hole 18 (see FIG. 3). A shape of the inclined surface 35 corresponds to a shape of a chamfering part 41 of the head hole 18 (see FIG. 3).

As shown in FIG. 7, an axis line h1 of the shaft hole 30 is inclined to an axis line z1 of the tip member. The inclination angle θ1 is a maximum value of an angle between the axis line h1 and the axis line z1. The axis line z1 of the tip member coincides with a center axis line of the definite-diameter circumferential surface 34. The axis line z1 of the tip member is substantially equal to an axis line of the head hole 18.

The shaft 6 is fixed to the shaft hole 30. The fixation is achieved by bond using a bonding agent. An outer surface of the shaft 6 is bonded to an inner surface of the shaft hole 30. The shaft 6 may be fixed to the shaft hole 30 by means other than bond.

The retention of the tip member 8 is achieved by screw connection. As shown in FIG. 3, the screw hole 32 of the tip member 8 is connected to the screw member 10 in a screwing manner. The screw connection prevents the coming off of the tip member 8. The hosel end face 37 and the bump surface 39 are brought into close contact with each other by an axial force caused by the screw connection. In order to ensure the axial force, a clearance K1 exists between a tip of the screw member 10 and a bottom face of the screw hole 32 in a state where the screw connection is completed (see FIG. 3).

The shaft side engaging part 38 of the tip member 8 has a first engaging part 42 having a convex part t1 provided at one place in a circumferential position, and a second engaging part 44 having convex parts t2 provided at twelve places in the circumferential position. The convex parts t2 are equally disposed in a circumferential direction. That is, the convex parts t2 are disposed at every 30 degrees.

The second engaging part 44 has rotational symmetry with the axis line z1 of the tip member as a rotational symmetric axis. The rotational symmetry implies that the shape of the second engaging part 44 rotated by (360/W) degrees around the rotational symmetric axis coincides with that of the unrotated second engaging part 44. W is an integer of equal to or greater than 2. The coincidence of the shape of the second engaging part 44 rotated by (360/W) degrees around the rotational symmetric axis with the shape of the unrotated second engaging part 44 is also referred to as "W-fold rotation symmetry". The second engaging part 44 has twelve-fold rotation-symmetry with respect to the axis line z1 of the tip member.

In the embodiment, the circumferential position of one of the convex parts t2 coincides with that of the convex part t1. The coincidence is not indispensable. A positional relationship between the convex part t1 and the convex part t2 in the circumferential direction is not restricted.

Figure 9:
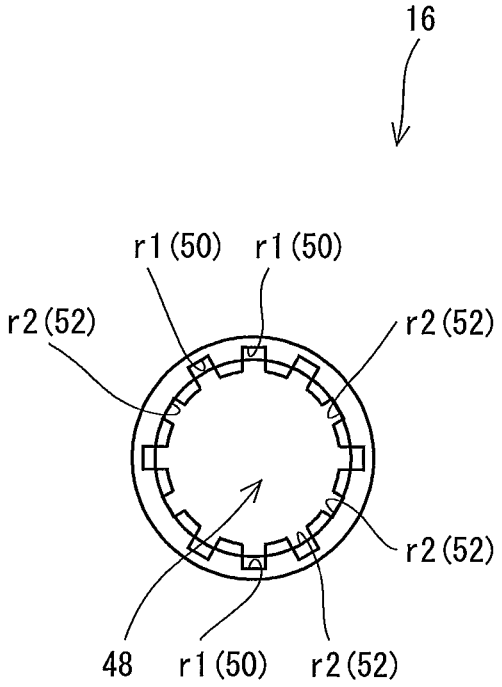
FIG. 9 is a plan view of an engaging member according to the first embodiment.

FIG. 9 is a plan view of the engaging member 16, as viewed from above. A positioning mark (a flat part) 46 is provided on an outer surface of the engaging member 16 (see FIG. 2).

The outer surface of the engaging member 16 is a circumferential surface having a fixed outer diameter. On the other hand, a head side engaging part 48 is provided in the engaging member 16. The head side engaging part 48 is formed of concave parts and convex parts. The head side engaging part 48 may be integrally formed as a part of the head body 14.

The head side engaging part 48 has a first portion 50 and a second portion 52. The first portion 50 is located on an axial directional upper side of the head side engaging part 48. The second portion 52 is located on an axial directional lower side to the first portion 50 (see FIG. 3).

The rotation stop of the tip member 8 is achieved by the engagement of the shaft side engaging part 38 and the head side engaging part 48. The shaft side engaging part 38 and the head side engaging part 48 are engaged with each other so that the relative rotation of the head 4 and the shaft 6 is regulated.

Figure 10:
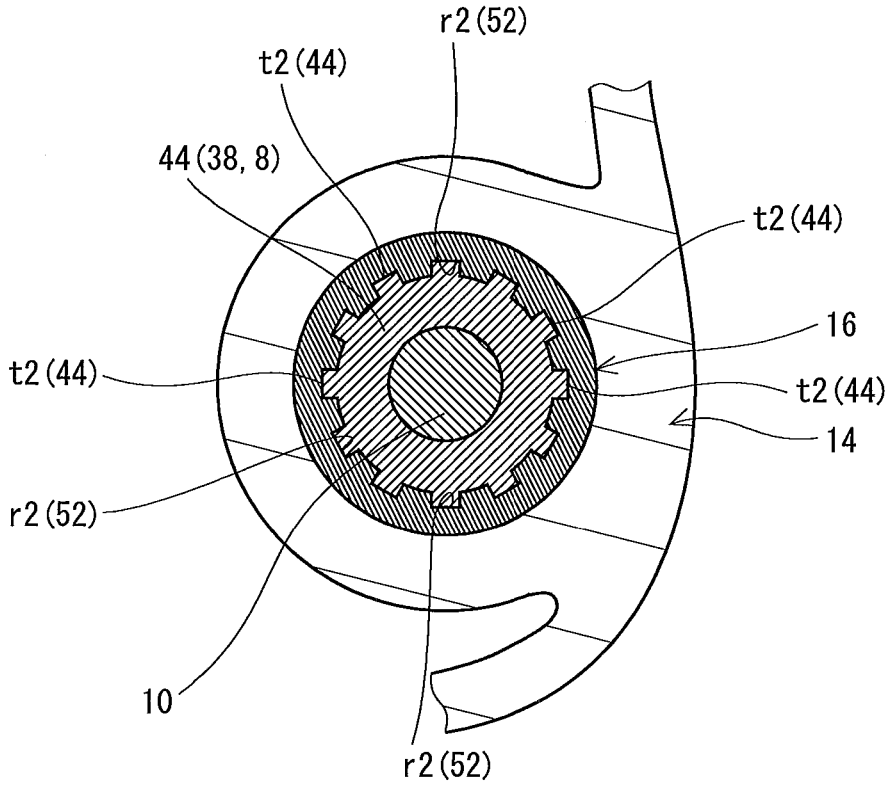
FIG. 10 is a cross sectional view taken along a line X-X of FIG. 3.
Figure 11:
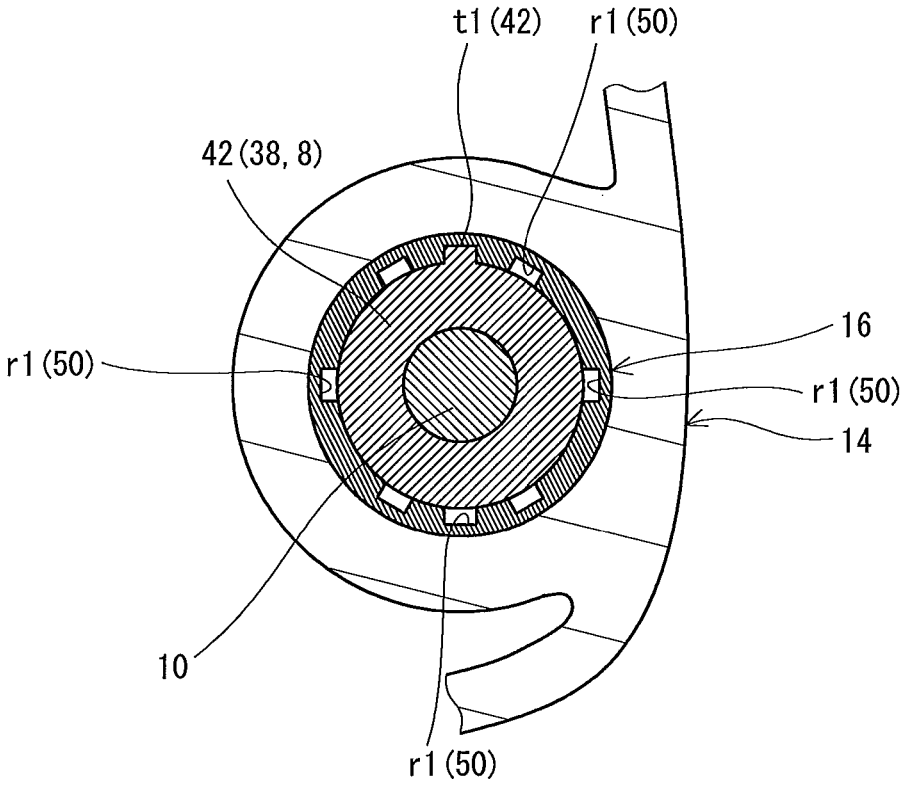
FIG. 11 is a cross sectional view taken along a line XI-XI of FIG. 3.

FIG. 10 is a cross sectional view taken along a line X-X of FIG. 3. FIG. 10 includes a section of the first portion 50. FIG. 11 is a cross sectional view taken along a line XI-XI of FIG. 3. FIG. 11 includes a section of the second portion 52.

As shown in FIG. 10, the second portion 52 has twelve concave parts r2 equally distributed in the circumferential direction. The twelve concave parts r2 are engaged with the twelve convex parts t2 of the second engaging part 44. The second portion 52 has twelve-fold rotation-symmetry with respect to the axis line z1 of the tip member.

As shown in FIG. 11, the first portion 50 has eight concave parts r1 unequally distributed in the circumferential direction. One of the eight concave parts r1 is engaged with the convex part t1 of the first engaging part 42.

As shown in FIG. 10, the circumferential relative positions in which the second engaging part 44 and the second portion 52 can be engaged with each other are twelve kinds. However, as shown in FIG. 11, the circumferential relative positions in which the first engaging part 42 and the first portion 50 can be engaged with each other are eight kinds. Therefore, the circumferential relative positions in which the shaft side engaging part 38 and the head side engaging part 48 can be engaged with each other are eight kinds.

Since the angle θ1 exists as described above, a loft angle, a lie angle and a hook angle can be changed due to the circumferential relative positions. In the embodiment, the loft angle, the lie angle and the hook angle can be adjusted due to eight kinds of circumferential relative positions. The loft angle, the lie angle and the hook angle suitable for each of golf players can be selected.

In the present application, the circumferential relative position is notated by a numerical value of 0 degree to 360 degrees. In respect of definite notation, a notation method of the circumferential relative position is defined as follows.

[Notation Method of Circumferential Relative Position]

(1) A circumferential relative position when the lie angle reaches to a maximum value is defined as 0 degree and 360 degrees. 0 degree and the 360 degrees imply the same circumferential relative position. The circumferential relative position is also referred to as a reference circumferential relative position.

(2) The tip member 8 (shaft 6) is rotated anticlockwise from a state of the reference circumferential relative position while the head 4 is fixed. Herein, the term "anticlockwise" which is not a rotation direction as viewed from a sole side, is a rotation direction, as viewed from a grip side. The term "anticlockwise" is a counterclockwise rotation. The circumferential relative position is notated by the rotation angle of the tip member 8 from the reference circumferential relative position. For example, the circumferential relative position when the tip member 8 is rotated anticlockwise by 30 degrees from the reference circumferential relative position is notated as "30 degrees".

In the present application, the notation method defined above is used. Hereinafter, a golf club for right-handed golf players will be described as an example.

The hook angle, the lie angle, and the loft angle are changed due to the circumferential relative position.

[Change of Hook Angle]

As the circumferential relative position approaches to 90 degrees between 0 degree and 90 degrees, the hook angle is increased. That is, as the circumferential relative position approaches to 90 degrees between 0 degree and 90 degrees, a face turns to the left side. When the circumferential relative position is 90 degrees, the hook angle reaches to a maximum value. The maximum value of the hook angle is Fmax.

As the circumferential relative position approaches to 270 degrees between 90 degrees and 270 degrees, the hook angle is decreased. That is, as the circumferential relative position approaches to 270 degrees between 90 degrees and 270 degrees, the face turns to the right side. When the circumferential relative position is 270 degrees, the hook angle reaches to a minimum value. The minimum value of the hook angle is Fmin.

As the circumferential relative position approaches to 360 degrees (0 degree) between 270 degrees and 360 degrees (0 degree), the hook angle is increased.

The hook angle at the circumferential relative positions of 0 degree and 180 degrees is equal to [(Fmax+Fmin)/2]. The hook angle is Fmid.

[Change of Lie Angle]

As the circumferential relative position approaches to 180 degrees between 0 degree and 180 degrees, the lie angle is decreased. When the circumferential relative position is 180 degrees, the lie angle reaches to a minimum value. The minimum value of the lie angle is Tmin. As the circumferential relative position approaches to 360 degrees (0 degree) between 180 degree and 360 degrees (0 degree), the lie angle is increased. When the circumferential relative position is 0 degree (360 degrees), the lie angle reaches to a maximum value. The maximum value of the lie angle is Tmax.

[Change of Loft Angle]

As the circumferential relative position approaches to 90 degrees between 0 degree and 90 degrees, the loft angle is increased. When the circumferential relative position is 90 degrees, the loft angle reaches to a maximum value. The maximum value of the loft angle is Lmax.

As the circumferential relative position approaches to 270 degrees between 90 degrees and 270 degrees, the loft angle is decreased. When the circumferential relative position is 270 degrees, the loft angle reaches to a minimum value. The minimum value of the loft angle is Lmin.

As the circumferential relative position approaches to 360 degrees between 270 degrees and 360 degrees, the loft angle is increased.

The loft angle at the circumferential relative positions of 0 degree and 180 degrees is equal to [(Lmax+Lmin)/2]. The loft angle is Lmid.

In the first embodiment, the fixable circumferential relative positions A are 0 degree, 30 degrees, 90 degrees, 150 degrees, 180 degrees, 210 degrees, 270 degrees, and 330 degrees. The fixable circumferential relative positions are unequally distributed in the circumferential direction.

The hook angle, the lie angle, and the loft angle of each of the circumferential relative positions A are shown in the following Table 1. Table 1 shows values when the inclination angle θ1 is set to 1.0 degree.

TABLE 1

Circumferential Relative Positions and Specifications of First Embodiment

| Circumferential relative position (degree) | Loft angle (degree) | Lie angle (degree) | Hook angle (degree) |
|---|---|---|---|
| 0 | 11.5 | 58.5 | 0.0 |
| 30 | 12.1 | 58.4 | 0.9 |
| 90 | 12.7 | 57.5 | 1.9 |
| 150 | 12.1 | 56.7 | 0.9 |
| 180 | 11.5 | 56.5 | 0.0 |
| 210 | 10.9 | 56.7 | −0.9 |
| 270 | 10.4 | 57.5 | −1.9 |
| 330 | 11.0 | 58.4 | −0.9 |
| 360 | 11.5 | 58.5 | 0.0 |

note)
Inclination angle θ 1 is 1.0 degree.

On the other hand, when the circumferential relative positions are equally distributed to eight places in the circumferential direction, the hook angle, the lie angle, and the loft angle of each of the circumferential relative positions are calculated as in the following Table 2. Table 2 also shows values when the inclination angle θ1 is set to 1.0 degree.

TABLE 2

Circumferential Relative Positions and Specifications in being equally divided into eight pieces in circumferential direction

| Circumferential relative position (degree) | Loft angle (degree) | Lie angle (degree) | Hook angle (degree) |
|---|---|---|---|
| 0 | 11.5 | 58.5 | 0.0 |
| 45 | 12.4 | 58.2 | 1.3 |
| 90 | 12.7 | 57.5 | 1.9 |
| 135 | 12.4 | 56.8 | 1.3 |
| 180 | 11.5 | 56.5 | 0.0 |
| 225 | 10.7 | 56.8 | −1.3 |
| 270 | 10.4 | 57.5 | −1.9 |
| 315 | 10.7 | 58.2 | −1.3 |
| 360 | 11.5 | 58.5 | 0.0 |

note)
Inclination angle θ 1 is 1.0 degree.

As appreciated from the comparison between data of Table 1 and data of Table 2, the adjustment distance of the loft angle, the lie angle, or the hook angle is equalized at the circumferential relative positions A (see Table 1) of the embodiment as compared with the circumferential relative positions B (see Table 2) in being equally divided into eight pieces in the circumferential direction.

For example, the hook angle will be described as an example. In the case of Table 2, a maximum value Bfmax of the adjustment distance (pitch) of the hook angle is 1.3 degrees, and a minimum value Bfmin thereof is 0.6 degree.

On the other hand, in the case of Table 1, a maximum value Afmax of the adjustment distance of the hook angle is 1.0 degree, and a minimum value Afmin thereof is 0.9 degree. At the circumferential relative positions B, the difference (Bfmax−Bfmin) between the maximum value Bfmax and the minimum value Bfmin is 0.7 degree. On the other hand, at the circumferential relative positions A, the difference (Afmax−Afmin) between the maximum value Afmax and the minimum value Afmin is 0.1 degree. The difference (Afmax−Afmin) is smaller than the difference (Bfmax−Bfmin).

Same applies to the loft angle. At the circumferential relative positions B of Table 2, a maximum value Brmax of the adjustment distance of the loft angle is 0.9 degree, and a minimum value Brmin thereof is 0.3 degree. On the other hand, in the case of Table 1, a maximum value Armax of the adjustment distance of the loft angle is 0.6 degree, and a minimum value Armin thereof is 0.5 degree. At the circumferential relative positions B, the difference (Brmax−Brmin) between the maximum value Brmax and the minimum value Brmin is 0.6 degree. On the other hand, at the circumferential relative positions A, the difference (Armax−Armin) between the maximum value Armax and the minimum value Armin is 0.1 degree. The difference (Armax−Armin) is smaller than the difference (Brmax−Brmin). The adjustment distance of the loft angle is equalized at the circumferential relative positions A of the embodiment as compared with the circumferential relative positions B.

The term "adjustment distance" is an absolute value of the difference of specifications between the adjacent circumferential relative positions. The specification is the loft angle, the lie angle, or the hook angle.

The equalization facilitates the adjustment of the hook angle, the lie angle or the loft angle, and the golf players can easily adjust the angle to favorite specifications. Particularly, the hook angle and the loft angle of the specifications tend to influence hitting ball results, and have high importance. The adjustment distance of the hook angle or the loft angle is more preferably equalized.

Figure 12:
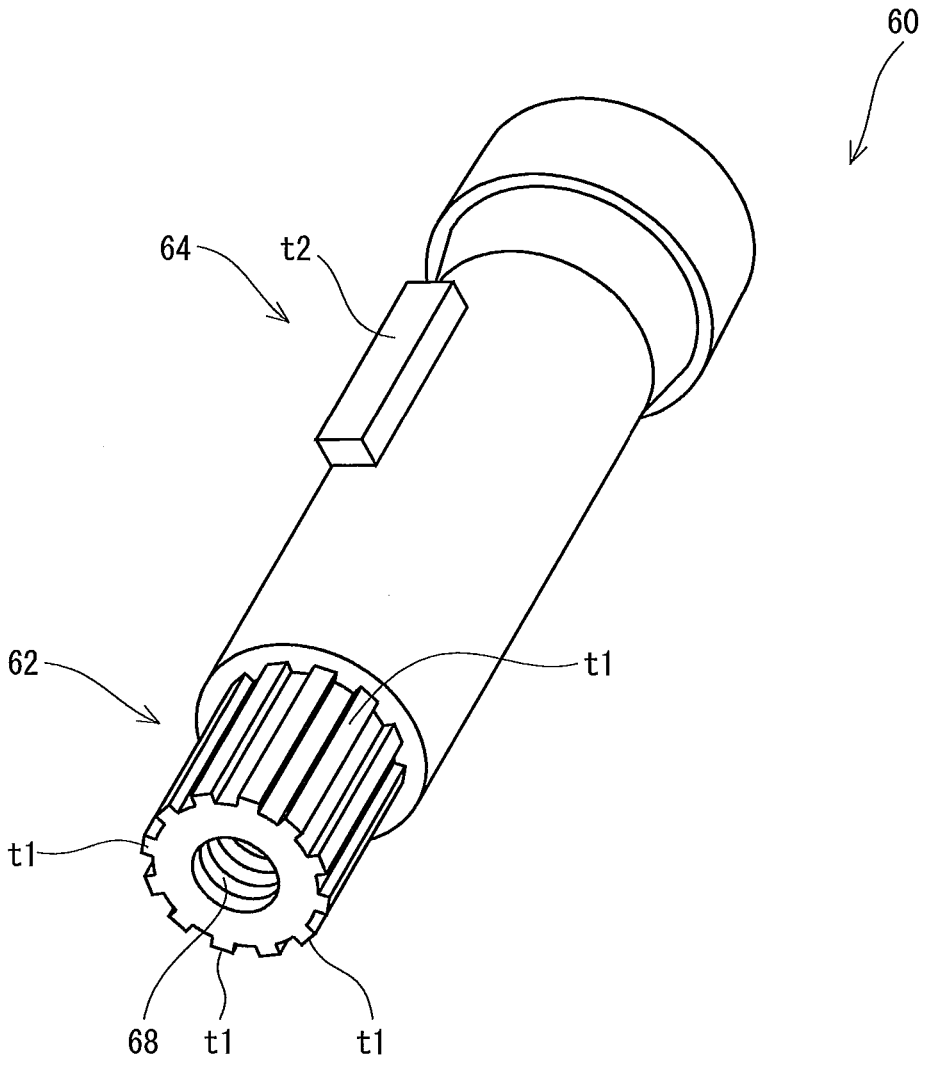
FIG. 12 is a perspective view of a tip member according to a second embodiment.
Figure 13:
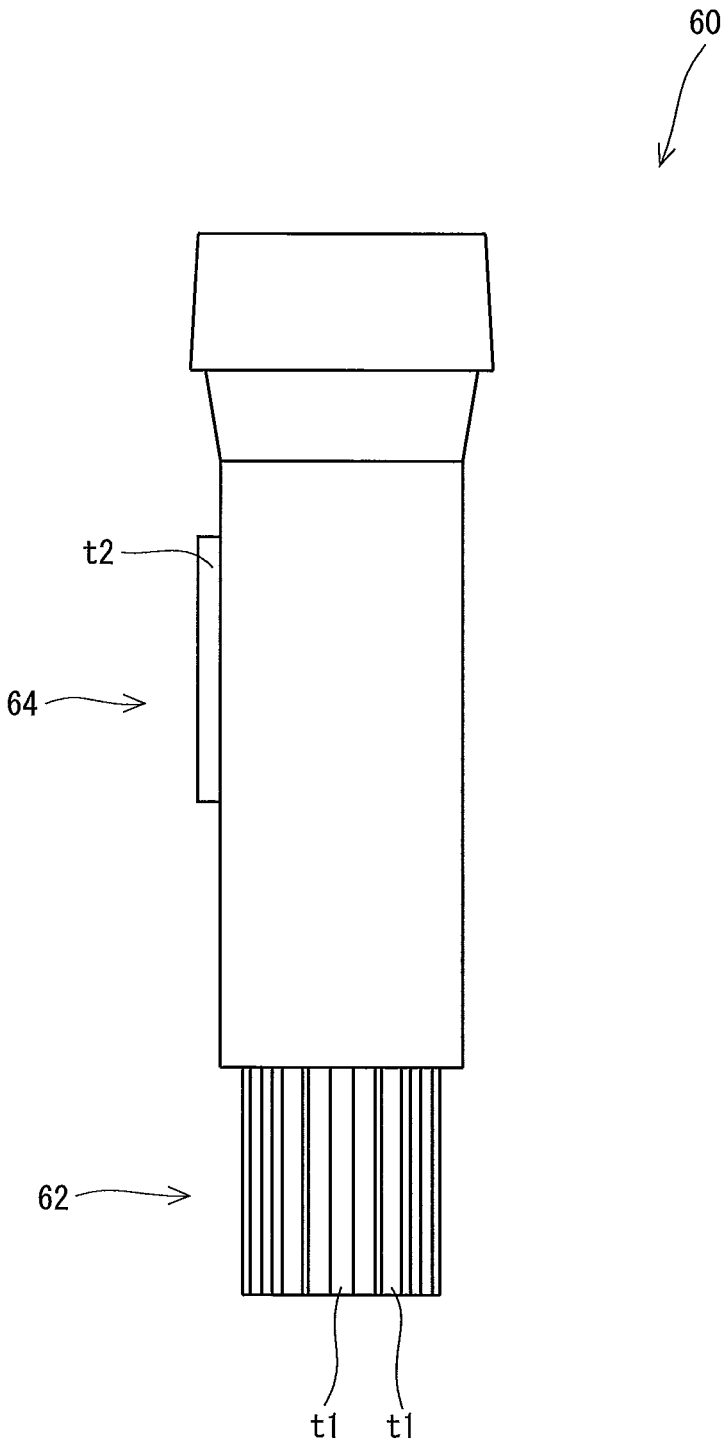
FIG. 13 is a side view of the tip member of FIG. 12.
Figure 14:
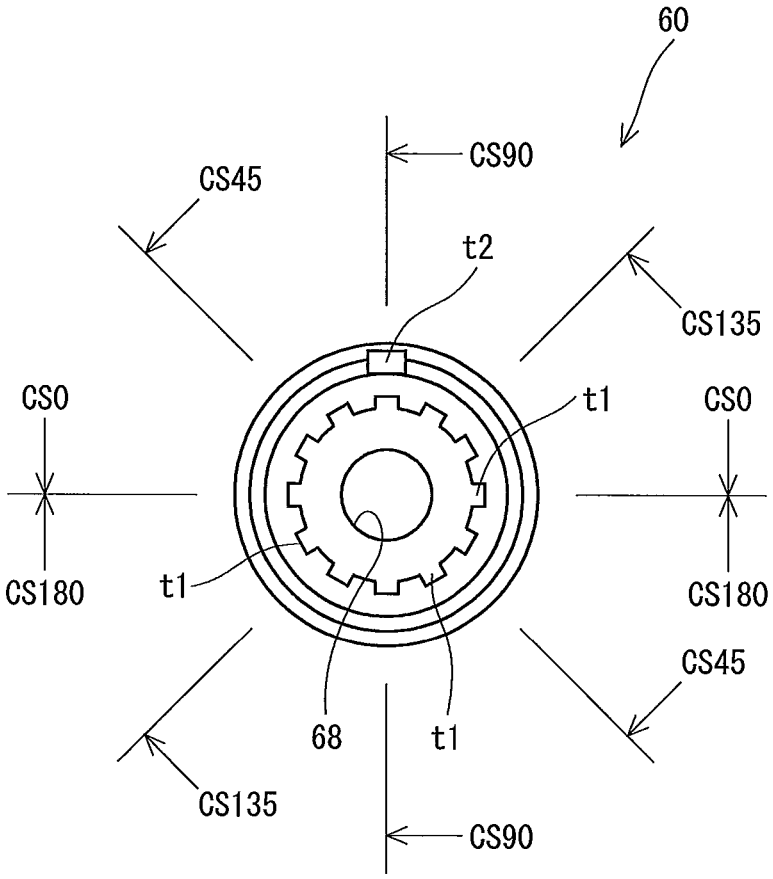
FIG. 14 is a bottom view of the tip member of FIG. 12.
Figure 15:
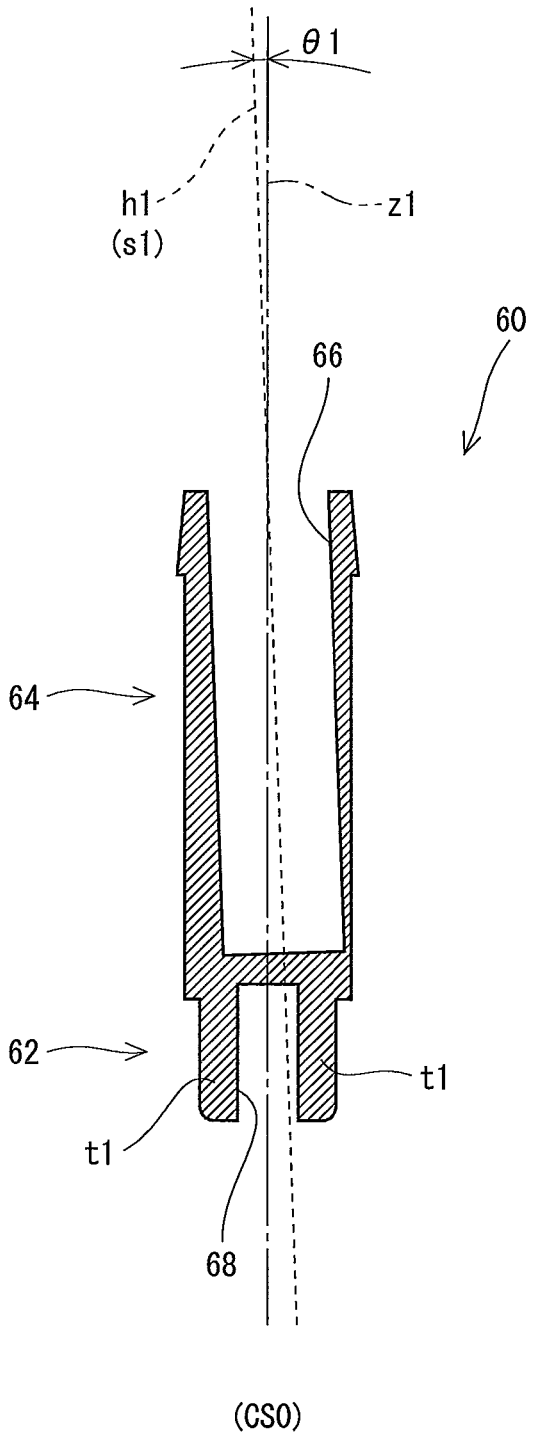
FIG. 15 is a cross sectional view taken along a line CS0-CS0 of FIG. 14.
Figure 16:
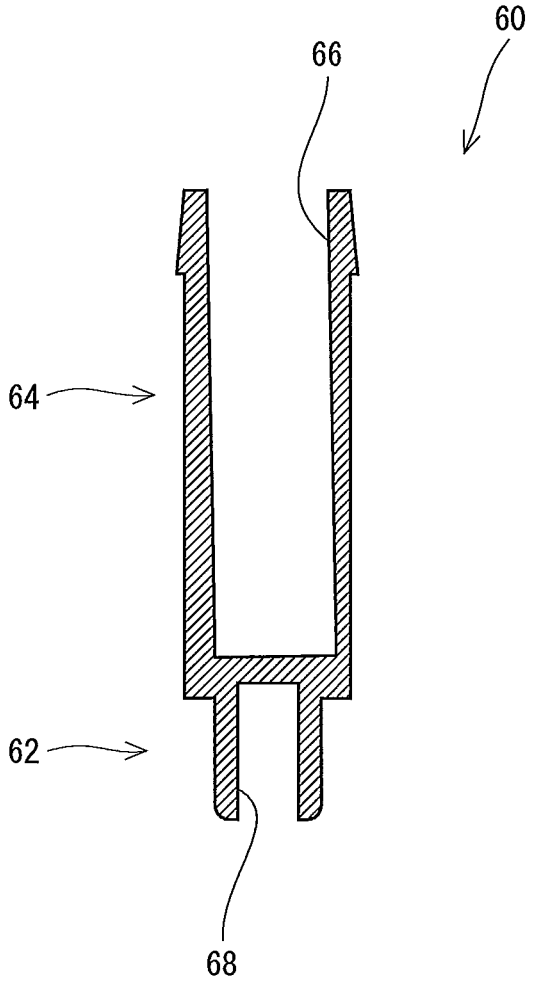
FIG. 16 is a cross sectional view taken along a line CS45-CS45 of FIG. 14.
Figure 17:
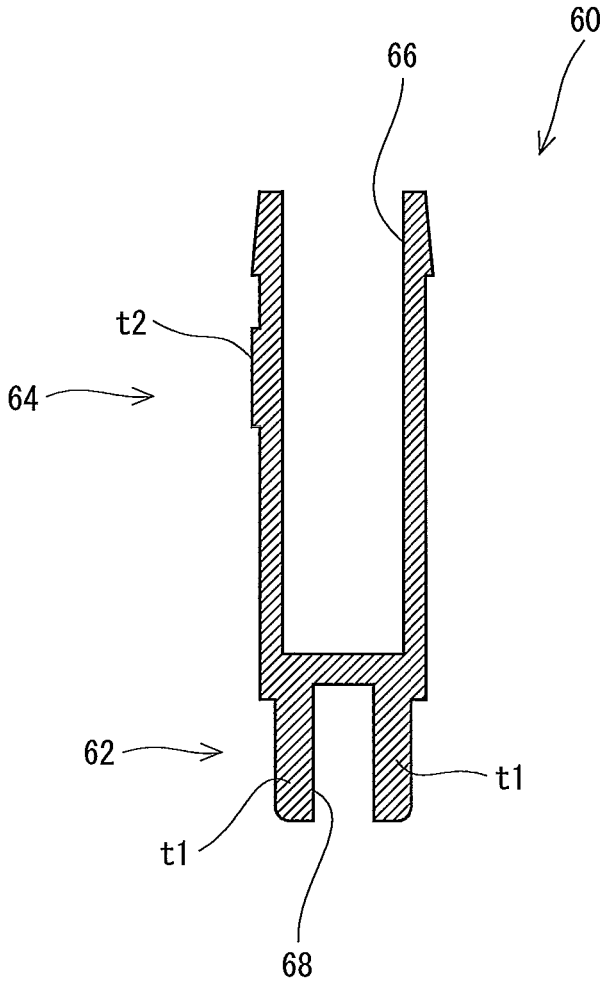
FIG. 17 is a cross sectional view taken along a line CS90-CS90 of FIG. 14.
Figure 18:
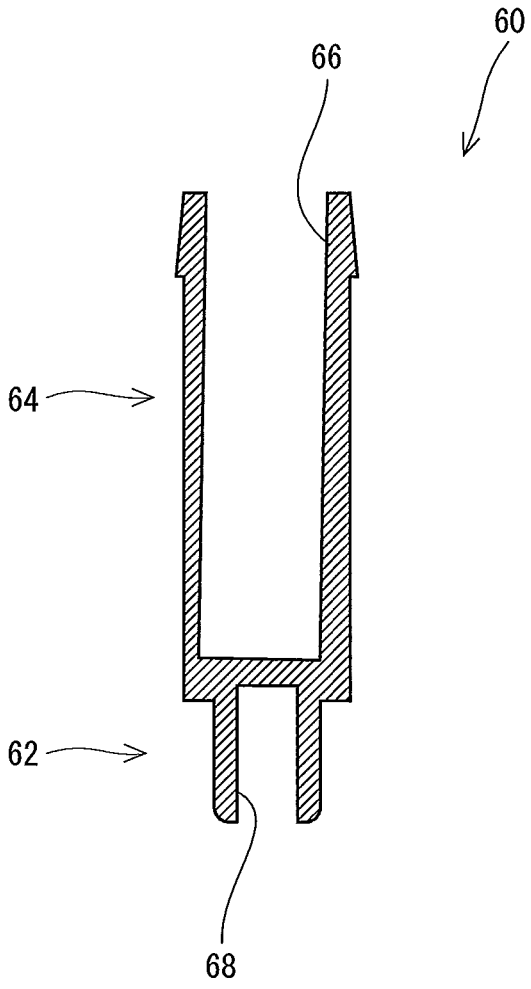
FIG. 18 is a cross sectional view taken along a line CS135-CS135 of FIG. 14.
Figure 19:
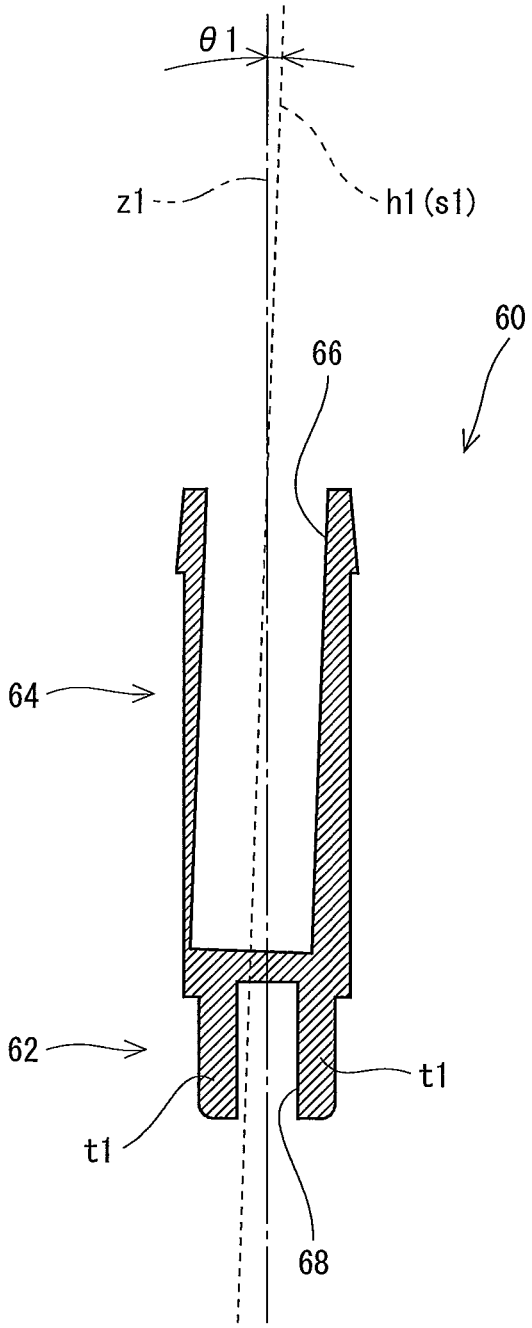
FIG. 19 is a cross sectional view taken along a line CS180-CS180 of FIG. 14.

FIG. 12 is a perspective view of a tip member 60 used for a golf club of a second embodiment. FIG. 13 is a side view of the tip member 60. FIG. 14 is a bottom view of the tip member 60. FIG. 15 is a cross sectional view taken along a line CS0-CS0 of FIG. 14. FIG. 16 is a cross sectional view taken along a line CS45-CS45 of FIG. 14. FIG. 17 is a cross sectional view taken along a line CS90-CS90 of FIG. 14. FIG. 18 is a cross sectional view taken along a line CS135-CS135 of FIG. 14. FIG. 19 is a cross sectional view taken along a line CS180-CS180 of FIG. 14. The cross sectional views of FIG. 15 to FIG. 19 are schematic views in which descriptions for detailed shapes are omitted.

The tip member 60 has a first engaging part 64, a second engaging part 62, a shaft hole 66, and a screw hole 68. The second engaging part 62 is formed by twelve convex parts t1 equally distributed in a circumferential direction. The first engaging part 64 is formed by a convex part t2 disposed at one place in the circumferential direction.

In the tip member 60, an angle relationship between an axis line s1 of a shaft (that is, an axis line h1 of the shaft hole 66) and an axis line z1 of the tip member is the same as that of the tip member 8. An inclination angle of the axis line s1 to the axis line z1 is an angle θ1.

Also in a golf club (illustration is omitted) for which the tip member 60 is used, fixable circumferential relative positions are eight kinds. In the embodiment, the second engaging part 62 can be fixed at 12 kinds (N kinds) of circumferential relative positions between the second engaging part 62 and a head side engaging part (illustration is omitted). As the head side engaging part engaged with the second engaging part 62, the same one as the second portion 52 of the above-mentioned engaging member 16 is exemplified. On the other hand, the first engaging part 64 can be fixed at eight kinds of circumferential relative positions A between the first engaging part 64 and the head side engaging part. As the head side engaging part engaged with the first engaging part 64, a groove is exemplified, which is formed on the inner surface of a head hole and extends along an axis direction from a hosel end face. The groove is formed in the same circumferential position as that of the first portion 50 of the engaging member 16.

In the embodiment, the eight kinds of fixable circumferential relative positions A are 0 degree, 30 degrees, 90 degrees, 150 degrees, 180 degrees, 210 degrees, 270 degrees, and 330 degrees as in the first embodiment. Also in the embodiment, the adjustment distance of specifications is equalized as in the first embodiment. The equalization facilitates the adjustment of a hook angle, a lie angle, or a loft angle, and the golf players can easily adjust the angle to favorite specifications.

Figure 20:
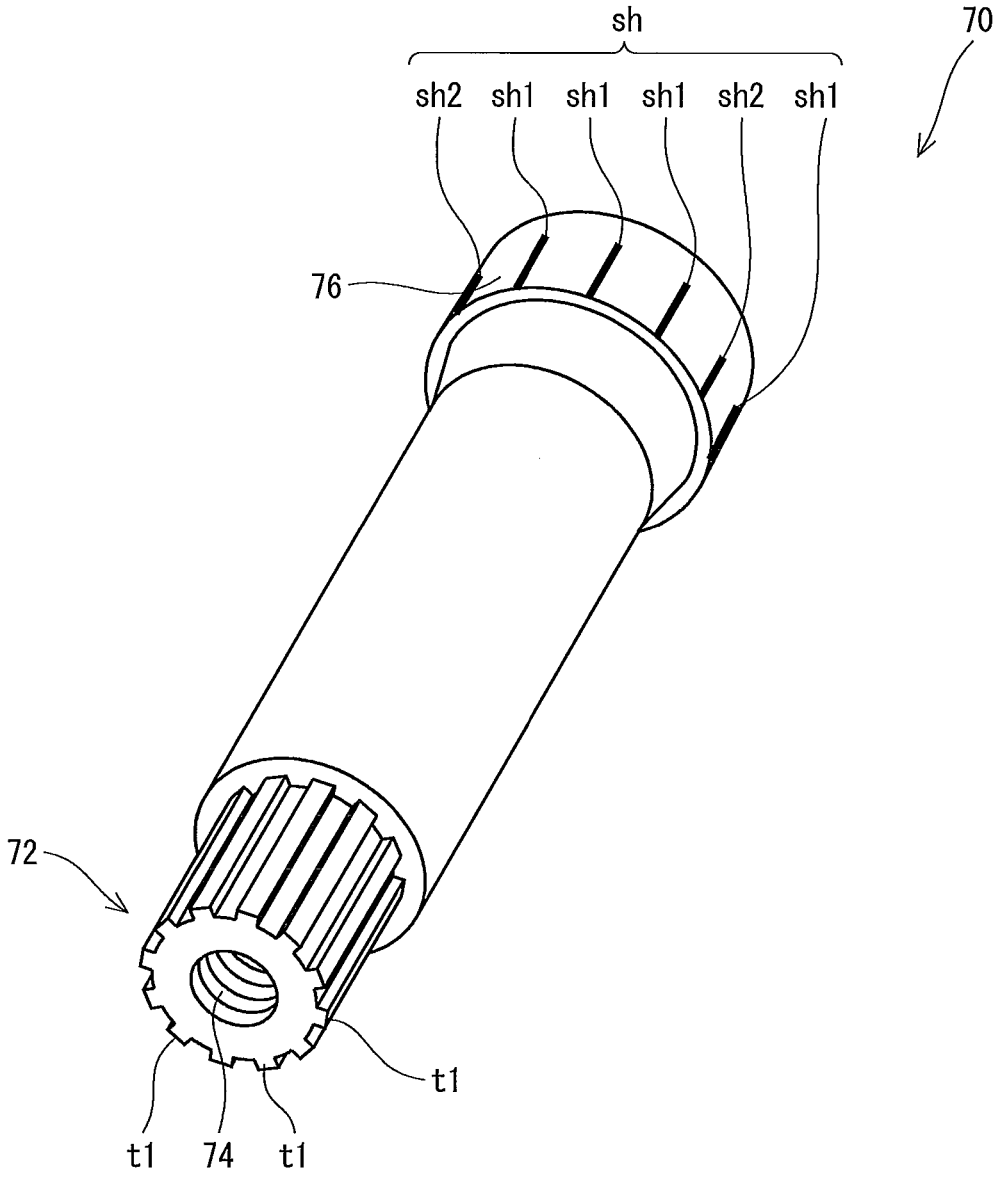
FIG. 20 is a perspective view of a tip member according to a third embodiment.
Figure 21:
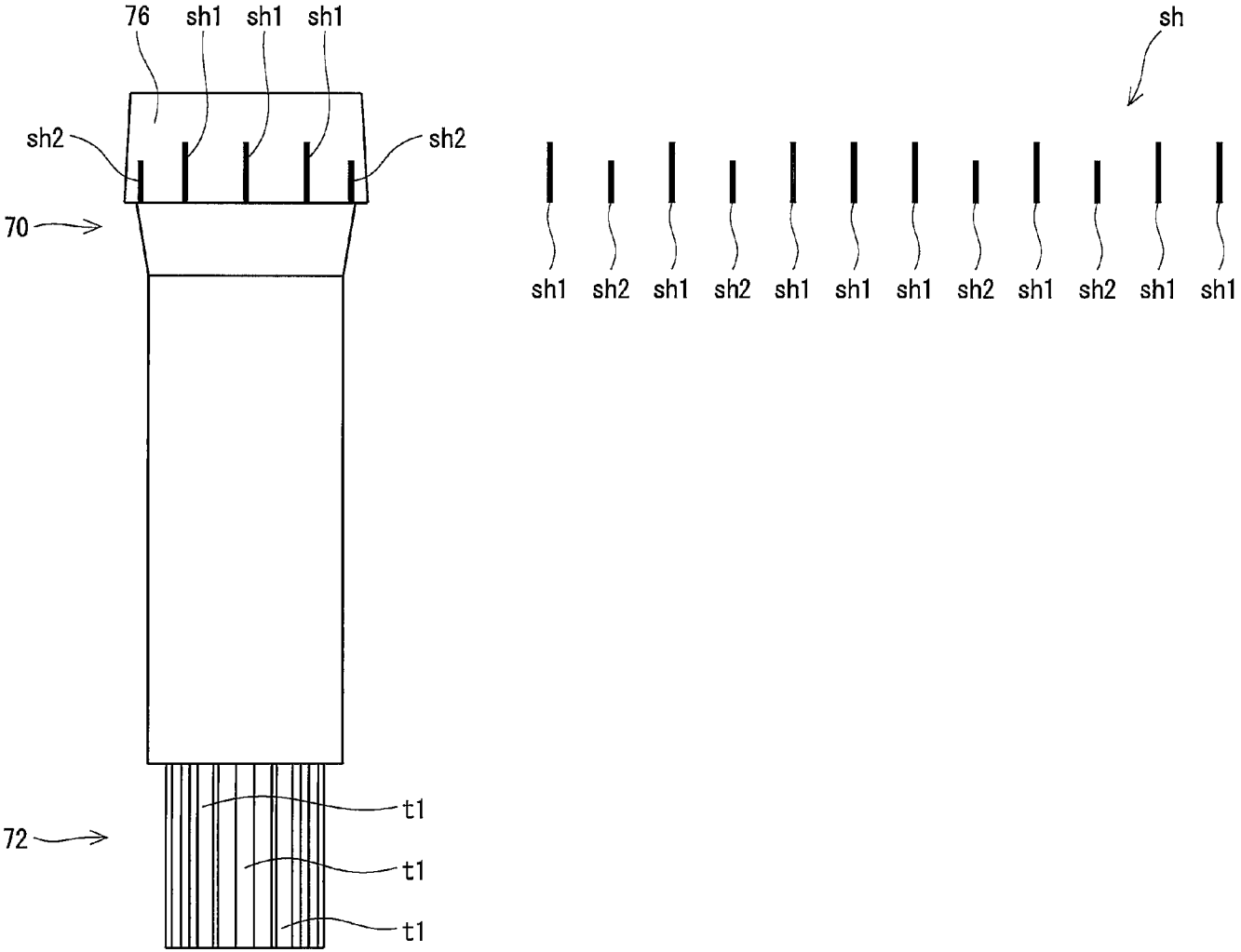
FIG. 21 is a side view of the tip member of FIG. 20, and FIG. 21 includes a developed view of an indication sh.
Figure 22:
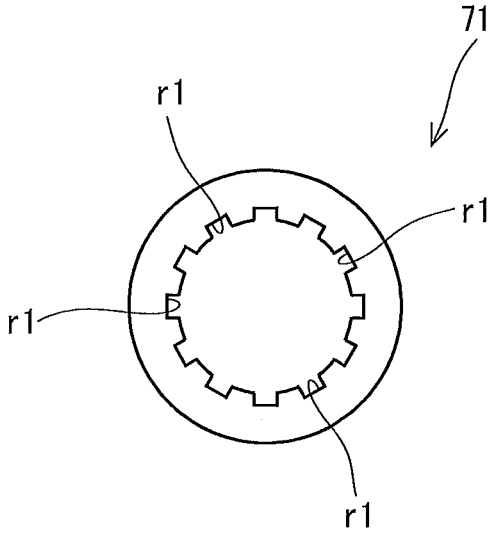
FIG. 22 is a plan view of an engaging member according to a third embodiment.

FIG. 20 is a perspective view of a tip member 70 according to a third embodiment. FIG. 21 is a side view of the tip member 70. FIG. 22 is a plan view of an engaging member 71 according to the third embodiment, as viewed from the upper side. The shape of the tip member 70 is the same as that of the tip member 60 except for the nonexistence of the convex part t2.

The tip member 70 has a shaft side engaging part 72, a shaft hole (not shown), and a screw hole 74. The shaft side engaging part 72 is formed by twelve convex parts t1 equally distributed in a circumferential direction.

The engaging member 71 is fixed to a bottom part of a head hole as in the engaging member 16 of the golf club 2. The engaging member 71 forms a head side engaging part. Twelve concave parts r1 equally distributed in the circumferential direction are formed on an inner surface of the engaging member 71. The shape of the inner surface of the engaging member 71 corresponds to that of an outer surface of the shaft side engaging part 72.

In the tip member 70, an angle relationship between an axis line s1 of a shaft (that is, an axis line h1 of the shaft hole) and an axis line z1 of a tip member is the same as in the tip member 8. An inclination angle of the axis line s1 to the axis line z1 is an angle θ1.

In a golf club (illustration is omitted) for which the tip member 70 is used, fixable circumferential relative positions are 12 kinds. That is, N=12 is set. In the embodiment, the shaft side engaging part 72 can be fixed at twelve kinds of circumferential relative positions between the shaft side engaging part 72 and the head side engaging part (the engaging member 71). That is, in the embodiment, twelve kinds of fixable circumferential relative positions A are all positions of every 30 degrees. That is, the circumferential relative positions A are 0 degree, 30 degrees, 60 degrees, 90 degrees, 120 degrees, 150 degrees, 180 degrees, 210 degrees, 240 degrees, 270 degrees, 300 degrees, and 330 degrees.

In the embodiment, an indication sh related to the circumferential relative positions is applied to the Lip member 70. In the embodiment, the indication sh is a scale.

The indication sh is provided on an exposed part 76 of the tip member 70. In this case, since the indication sh is easily viewable, the specifications can be easily adjusted. As shown in other embodiments to be described later, the indication sh may be provided at a position which is not viewed in the assembled golf club. The indication sh may be provided on both the exposed part and an unexposed part.

The indication sh is provided at every 30 degrees along the entire circumferential direction. The circumferential positions of the indication sh correspond to the twelve kinds of circumferential relative positions A. That is, any of the twelve kinds of circumferential relative positions A can be selected by matching one of the scales included in the indication sh with a position of an indication (not shown) provided on a head.

The indication sh includes key indications sh1. The indication sh also includes non-key indications sh2. The key indication sh1 is more conspicuous than the non-key indication sh2.

The indication sh is not restricted as long as the indication sh is visually detected. Similarly, the head side indication is not restricted. As the example of the indication sh, a character, a symbol, a scale, a line, and a combination thereof are exemplified. The indication sh may be two-dimensionally shown, and may be three-dimensionally shown by a concave part or a convex part. The head side indication may exist at least one place.

In the present application, the term "key indication" is used. The meaning of the term is uniquely defined in the present application. The "key indication" is "an indication corresponding to a specific circumferential relative position" in the following [Conformation 1] and [Conformation 2].

[Conformation 1]

The indication corresponding to the specific circumferential relative position is more conspicuous than an indication corresponding to other circumferential relative position.

[Conformation 2]

Only the indication corresponding to the specific circumferential relative position exists, and the indication corresponding to other circumferential relative positions does not exist.

Examples of the [Conformation 1] are as follows. The examples of the [Conformation 1] are not restricted to the following items.

[1-1]: Lines (a scale, a character, a symbol, or the like) of an indication corresponding to the specific circumferential relative position are longer than those of an indication corresponding to other circumferential relative positions.

[1-2]: The lines of the indication corresponding to the specific circumferential relative position are thicker than those of the indication corresponding to the other circumferential relative positions.

[1-3]: The indication corresponding to the specific circumferential relative position has a chromatic color, and the indication corresponding to the other circumferential relative positions has an achromatic color.

[1-4]: Scales are applied to positions corresponding to all the circumferential relative positions. A character or a symbol is applied to the position corresponding to the specific circumferential relative position. The character or the symbol is not applied to the position corresponding to the other circumferential relative positions.

[1-5]: The character or the symbol is applied to the position corresponding to the specific circumferential relative position. The scale is applied to the position corresponding to the other circumferential relative positions.

[1-6]: The indication corresponding to the specific circumferential relative position is three-dimensional. The indication corresponding to the other circumferential relative positions is two-dimensional.

[1-7]: The indication corresponding to the specific circumferential relative position is a three-dimensional convex part A. The indication corresponding to the other circumferential relative positions is a three-dimensional convex part B. The convex part A is higher than the convex part B.

[1-8]: The indication corresponding to the specific circumferential relative position is the three-dimensional convex part A. The indication corresponding to the other circumferential relative positions is the three-dimensional convex part B. The convex part A is thicker than the convex part B.

[1-9]: The indication corresponding to the specific circumferential relative position is the three-dimensional convex part A. The indication corresponding to the other circumferential relative positions is the three-dimensional convex part B. The convex part A is longer than the convex part B.

[1-10]: The indication corresponding to the specific circumferential relative position is the three-dimensional convex part A. The indication corresponding to the other circumferential relative positions is the three-dimensional convex part B. The number of the convex parts A is more than that of the convex parts B.

[1-11]: The number of the indications (the number of the lines such as the character and the scale) corresponding to the specific circumferential relative position is more than the number of the indications corresponding to the other circumferential relative positions.

In the embodiment, eight (X) indications sh of twelve indications sh showing the twelve kinds of circumferential relative positions are the key indication sh1 (see FIGS. 20 and 21). The remaining four indications are the non-key indication sh2. The embodiment is an example of the [Conformation 1]. The embodiment is an example of the Conformation [1-1]. The embodiment is an example of the Conformation [1-2]. In the embodiment, X in claims is 8.

On the right side of FIG. 21, the indication sh described at twelve places in the circumferential direction is developed in a plane and is shown. The key indications sh1 are disposed at positions corresponding to the circumferential relative positions of 0 degree, 30 degrees, 90 degrees, 150 degrees, 180 degrees, 210 degrees, 270 degrees, and 330 degrees. On the other hand, the non-key indications sh2 are disposed at positions corresponding to the other circumferential relative positions. That is, the non-key indications sh2 are disposed at positions corresponding to the circumferential positions of 60 degrees, 120 degrees, 240 degrees, and 300 degrees.

The non-key indication sh2 may not exist. This case corresponds to the [Conformation 2].

The key indication sh1 has a scale having a length longer than that of the non-key indication sh2. The conformation is an example of the key indications. As the other example, for example, the scale of the key indication sh1 may be thicker than that of the non-key indication sh2.

Thus, the embodiment provides the key indications corresponding to eight kinds of circumferential relative positions C of the twelve kinds of circumferential relative positions A. In the embodiment, the circumferential relative positions C can equalize the adjustment distance of a loft angle, a lie angle, or a hook angle as compared with the circumferential relative positions D in being equally divided into eight pieces in the circumferential direction. The meaning of the equalization is described in the first embodiment.

The golf players tend to be induced to the key indication. The golf players tend to be induced to the equalized circumferential relative positions. Therefore, the specifications are easily adjusted.

The character or number included in the indication sh may be related with the value of the hook angle, the loft angle, or the lie angle. For example, "+1" or the like may be indicated at the circumferential relative position in which the hook angle is increased by 1 degree as compared with the case where the circumferential relative position is 0 degree, and "−1" or the like may be indicated at the circumferential relative position in which the hook angle is decreased by 1 degree. It is preferable that the indication related with the value of the hook angle, the loft angle, or the lie angle constitutes the key indication sh1.

Figure 23:
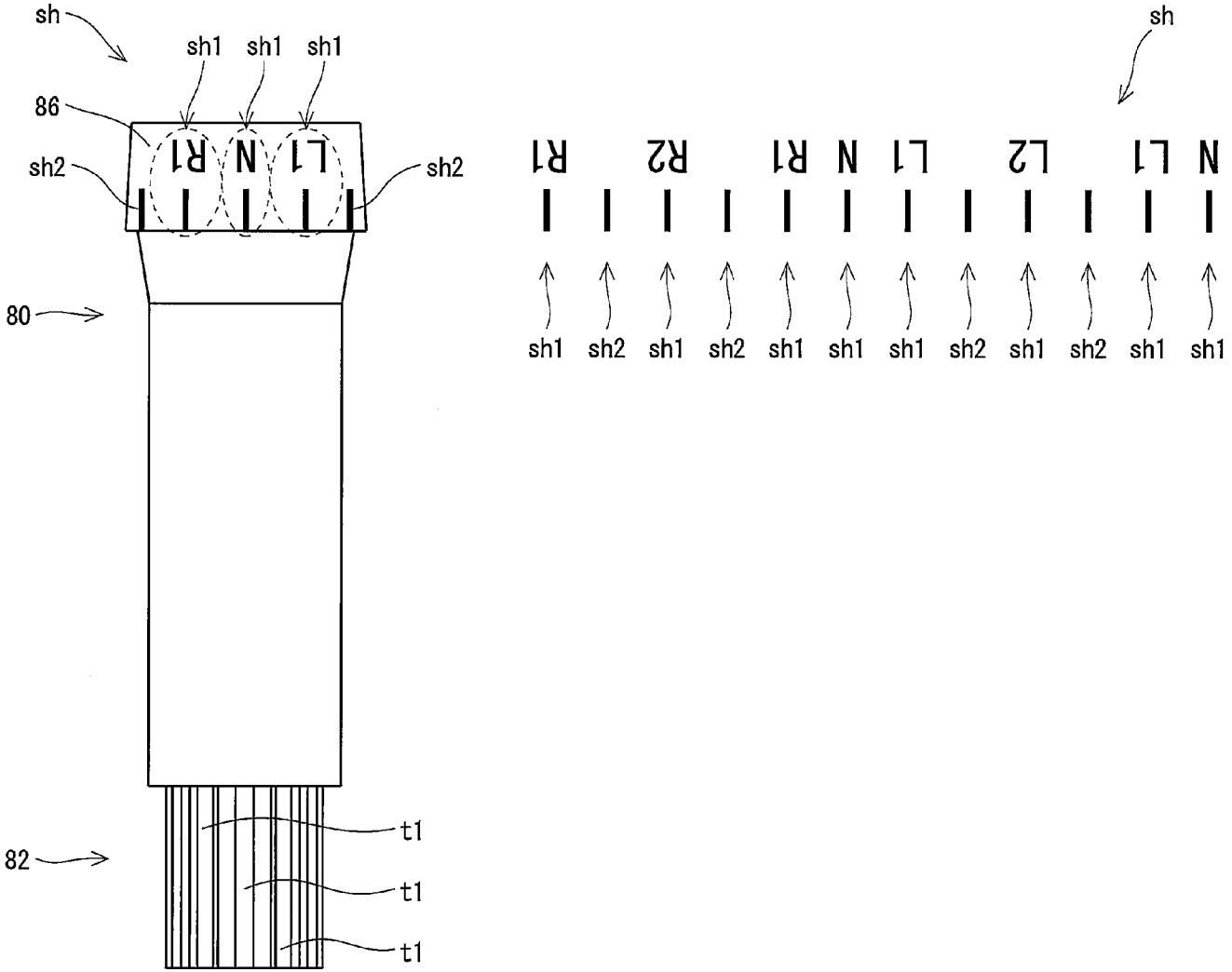
FIG. 23 is a side view of a tip member according to a fourth embodiment, and FIG. 23 includes a developed view of an indication sh.

FIG. 23 is a side view of a tip member 80 according to a fourth embodiment. The tip member 80 is the same as the tip member 70 except for an indication sh.

The tip member 80 has a shaft side engaging part 82, a shaft hole (not shown), and a screw hole (not shown). The shaft side engaging part 82 is formed by twelve convex parts t1 equally distributed in a circumferential direction.

The engaging member 71 is used for a golf club using the tip member 80. The engaging member 71 forms a head side engaging part as in the third embodiment.

In the tip member 80, an angle relationship between an axis line s1 of a shaft (that is, an axis line h1 of the shaft hole) and an axis line z1 of a tip member is the same as that of the tip member 8.

In a golf club (illustration is omitted) using the tip member 80, fixable circumferential relative positions are twelve kinds. In the embodiment, the shaft side engaging part 82 can be fixed at twelve kinds of circumferential relative positions between the shaft side engaging part 82 and the head side engaging part (the engaging member 71). That is, in the embodiment, twelve kinds of fixable circumferential relative positions A are all positions of every 30 degrees. That is, the circumferential relative positions A are 0 degree, 30 degrees, 60 degrees, 90 degrees, 120 degrees, 150 degrees, 180 degrees, 210 degrees, 240 degrees, 270 degrees, 300 degrees, and 330 degrees.

In the embodiment, an indication sh related to the circumferential relative positions is applied to the tip member 80. In the embodiment, the indication sh is a scale and a character.

The indication sh is provided on an exposed part 86 of the tip member 80. In this case, since the indication sh is easily viewable, the specifications can be easily adjusted. The indication sh may be provided at a position which is not viewed in the assembled golf club.

The indication sh is provided at every 30 degrees along the entire circumferential direction. The circumferential positions of the indication sh correspond to the twelve kinds of circumferential relative positions A. That is, any of the twelve kinds of circumferential relative positions A can be selected by matching one of the scales included in the indication sh with a position of an indication (not shown) provided on a head.

The indication sh includes key indications sh1. The indication sh also includes non-key indications sh2.

In the embodiment, the key indications sh1 are a character and a scale, and the non-key indication sh2 is a scale (only a scale). The key indication sh1 is more conspicuous than the non-key indication sh2.

In the embodiment, eight indications sh of twelve indications sh showing the twelve kinds of circumferential relative positions are the key indication sh1. The remaining four indications are the non-key indication sh2. The embodiment is an example of the [Conformation 1]. The embodiment is an example of the Conformation [1-4].

On the right side of FIG. 23, the indication sh described at twelve places in the circumferential direction is developed in a plane and is shown. The key indications sh1 are disposed at positions corresponding to the circumferential relative positions of 0 degree, 30 degrees, 90 degrees, 150 degrees, 180 degrees, 210 degrees, 270 degrees, and 330 degrees. On the other hand, the non-key indications sh2 are disposed at positions corresponding to the other circumferential relative positions. That is, the non-key indications sh2 are disposed at positions corresponding to the circumferential positions of 60 degrees, 120 degrees, 240 degrees, and 300 degrees.

The non-key indication sh2 may not exist. This case corresponds to the [Conformation 2].

The difference between the key indication sh1 and the non-key indication sh2 is the existence or nonexistence of a character. The key indication sh1 is more conspicuous than the non-key indication sh2.

Thus, the embodiment provides the key indications corresponding to eight kinds of circumferential relative positions C of the twelve kinds of circumferential relative positions A. In the embodiment, the circumferential relative positions C can equalize the adjustment distance of a loft angle, a lie angle, or a hook angle as compared with the circumferential relative positions D in being equally divided into eight pieces in the circumferential direction. The meaning of the equalization is described in the first embodiment.

The golf players tend to be induced to the key indication. The golf players tend to be induced to the equalized circumferential relative positions. The specifications can be easily adjusted due to the key indication.

Figure 24:
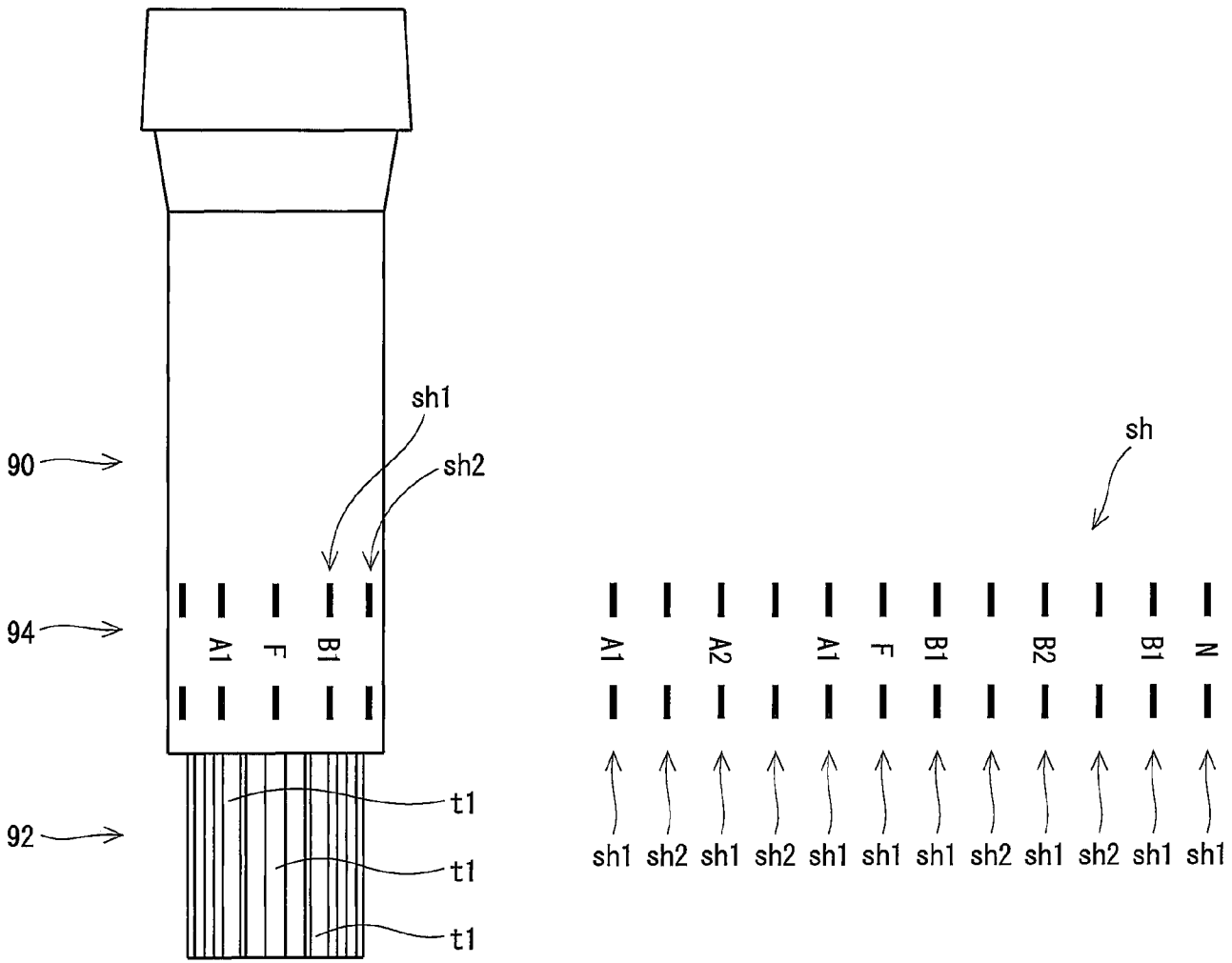
FIG. 24 is a side view of a tip member according to a fifth embodiment, and FIG. 24 includes a developed view of an indication sh.

FIG. 24 is a side view of a tip member 90 according to a fifth embodiment. The tip member 90 is the same as the tip member 70 except for an indication sh.

The tip member 90 has a shaft side engaging part 92, a shaft hole (not shown), and a screw hole (not shown). The shaft side engaging part 92 is formed by twelve convex parts t1 equally distributed in a circumferential direction.

The engaging member 71 is used for a golf club using the tip member 90. The engaging member 71 forms ahead side engaging part as in the third embodiment.

In the tip member 90, an angle relationship between an axis line s1 of a shaft (that is, an axis line h1 of the shaft hole) and an axis line z1 of a tip member is the same as that of the tip member 8.

In a golf club (illustration is omitted) using the tip member 90, fixable circumferential relative positions are twelve kinds. In the embodiment, the shaft side engaging part 92 can be fixed at twelve kinds of circumferential relative positions between the shaft side engaging part 92 and the head side engaging part (the engaging member 71). That is, in the embodiment, twelve kinds of fixable circumferential relative positions A are all positions of every 30 degrees. That is, the circumferential relative positions A are 0 degree, 30 degrees, 60 degrees, 90 degrees, 120 degrees, 150 degrees, 180 degrees, 210 degrees, 240 degrees, 270 degrees, 300 degrees and 330 degrees.

In the embodiment, indications sh related to the circumferential relative positions are applied to the tip member 90. In the embodiment, the indication sh is a scale and a character.

The indication sh is provided on an non-exposed part 94 of the tip member 90. In this case, the indication sh is not viewed in the assembled golf club. The indication sh does not exist on an usual golf club. Therefore, golf players having a preference for the non-viewed indication sh may also exist.

The indication sh is provided at every 30 degrees along the entire circumferential direction. The circumferential position of the indication sh corresponds to the twelve kinds of circumferential relative positions A. That is, any of the twelve kinds of circumferential relative positions A can be selected by matching one of the scales included in the indication sh with a position of an indication (not shown) provided on a head.

The indication sh includes key indications sh1. The indication sh also includes non-key indications sh2.

In the embodiment, the key indications sh1 are a character and a scale, and the non-key indication sh2 is a scale (only a scale). The key indication sh1 is more conspicuous than the non-key indication sh2.

In the embodiment, eight indications sh of twelve indications sh showing the twelve kinds of circumferential relative positions are the key indication sh1. The remaining four indications are the non-key indication sh2. The embodiment is an example of the [Conformation 1]. The embodiment is an example of the Conformation [1-4].

On the right side of FIG. 24, the indication sh described at twelve places in the circumferential direction is developed in a plane and is shown. The key indications sh1 are disposed at positions corresponding to the circumferential relative positions of 0 degree, 30 degrees, 90 degrees, 150 degrees, 180 degrees, 210 degrees, 270 degrees, and 330 degrees. On the other hand, the non-key indications sh2 are disposed at positions corresponding to the other circumferential relative positions. That is, the non-key indications sh2 are disposed at positions corresponding to the circumferential positions of 60 degrees, 120 degrees, 240 degrees, and 300 degrees.

The non-key indication sh2 may not exist. This case corresponds to the [Conformation 2].

The difference between the key indication sh1 and the non-key indication sh2 is the existence or nonexistence of a character. The key indication sh1 is more conspicuous than the non-key indication sh2.

Thus, the embodiment provides the key indications corresponding to eight kinds of circumferential relative positions C of the twelve kinds of circumferential relative positions A. In the embodiment, the circumferential relative positions C can equalize the adjustment distance of a loft angle, a lie angle, or a hook angle as compared with the circumferential relative positions D in being equally divided into eight pieces in the circumferential direction. The meaning of the equalization is described in the first embodiment.

The golf players tend to be induced to the key indication. The golf players tend to be induced to the equalized circumferential relative positions. The specifications can be easily adjusted due to the key indication.

In the first embodiment and the second embodiment, eight kinds of the fixable circumferential relative positions A include the following circumferential relative position X and circumferential relative position Y.

[Circumferential Relative Position X]

The circumferential relative position X is a circumferential relative position enabling adjustment to a hook angle Fa satisfying the following expression (1) when the maximum value Fmax of the hook angle, the minimum value Fmin of the hook angle, and the calculated value Fmid are substituted.

$$Fmid+(Fmax-Fmid)\times 0.4\leq Fa\leq Fmid+(Fmax-Fmid)\times 0.6 \quad (1)$$

[Circumferential Relative Position Y]

The circumferential relative position Y is a circumferential relative position enabling adjustment to a hook angle Fb satisfying the following expression (2) when the maximum value Fmax of the hook angle, the minimum value Fmin of the hook angle, and the calculated value Fmid are substituted.

$$Fmin+(Fmid-Fmin)\times 0.4\leq Fb\leq Fmin+(Fmid-Fmin)\times 0.6 \quad (2)$$

As understood from Table 1, in the first embodiment and the second embodiment, Fmax is 1.9 degrees; Fmin is −1.9 degrees; and Fmid is 0 degree. Therefore, values are calculated as follows.

$$Fmid+(Fmax-Fmid)\times 0.4=0.76$$

$$Fmid+(Fmax-Fmid)\times 0.6=1.14$$

$$Fmin+(Fmid-Fmin)\times 0.4=-1.14$$

$$Fmin+(Fmid-Fmin)\times 0.6=-0.76$$

Referring to the data of Table 1, the circumferential relative positions satisfying the expression (1) are 30 degrees and 150 degrees. The hook angle Fa is 0.9 degree. Referring to the data of Table 1, the circumferential relative positions satisfying the expression (2) are 210 degrees and 330 degrees. The hook angle Fb is −0.9 degree.

Thus, in the first embodiment and the second embodiment, eight kinds of the fixable circumferential relative positions A include the circumferential relative positions X (30 degrees and 150 degrees) and the circumferential relative positions Y (210 degrees and 330 degrees).

In the third embodiment, the fourth embodiment, and the fifth embodiment, the circumferential relative positions C equalize the adjustment distance of the loft angle and the hook angle as compared with the circumferential relative positions D in being equally divided into eight pieces in the circumferential direction. The aspect of the equalization is the same as the first embodiment and the second embodiment.

The third embodiment, the fourth embodiment and the fifth embodiment will be described as follows. At the circumferential relative position C, a maximum value of the hook angle is defined as Fmax; a minimum value of the hook angle is defined as Fmin; and a value calculated according to the expression [(Fmax+Fmin)/2] is defined as Fmid. In this case, the circumferential relative position enabling the adjustment to the hook angle Fa satisfying the expression (1) and the circumferential relative position enabling the adjustment to the hook angle Fb satisfying the expression (2) exist. In the third embodiment, the fourth embodiment, and the fifth embodiment, Fmax is 1.9 degrees; Fmin is −1.9 degrees; and Fmid is 0 degree. A relationship between the third embodiment and the expressions (1) and (2) is the same as the case of the first embodiment. A relationship between the fourth embodiment and the expressions (1) and (2) is the same as the case of the first embodiment. A relationship between the fifth embodiment and the expressions (1) and (2) is the same as the case of the first embodiment.

In the first and second embodiments, the circumferential relative positions A in which the head side engaging part and the shaft side engaging part are engaged with each other are set to M kinds. In the first embodiment and the second embodiment, an integer M is set to 8. In respect of reducing the adjustment distance to increase the options of the adjustment, the integer M is preferably equal to or greater than 3, more preferably equal to or greater than 6, and still more preferably equal to or greater than 8. In respect of the manufacture costs of the tip member and the head, the integer M is preferably equal to or less than 30, more preferably equal to or less than 20, and particularly preferably equal to or less than 12.

In the third, fourth, and fifth embodiments, the circumferential relative positions A in which the head side engaging part and the shaft side engaging part are engaged with each other are set to N kinds. Key indications corresponding to the X kinds (X is an integer smaller than N) of circumferential relative positions C of the N kinds of circumferential relative positions A are provided. In respect of reducing the adjustment distance to increase the options of the adjustment, an integer N is preferably equal to or greater than 8, and more preferably equal to or greater than 12. In respect of the manufacture costs of the tip member and the head, the integer N is preferably equal to or less than 30, more preferably equal to or less than 20, and particularly preferably equal to or less than 16. In respect of reducing the adjustment distance, an integer X is preferably equal to or greater than 3, more preferably equal to or greater than 6, and still more preferably equal to or greater than 8. When the number of the indications sh is excessively many, the adjustment distance may be excessively reduced. In this respect, the integer X is preferably equal to or less than 12, and more preferably equal to or less than 10.

The minimum value Afmin and the maximum value Afmax of the adjustment distance of the hook angle at the circumferential relative position A are not restricted. When the adjustment distance is excessively small, it may be actually difficult to adjust the adjustment distance. In this respect, the minimum value Afmin is preferably equal to or greater than 0.5 degree, more preferably equal to or greater than 0.7 degree, and still more preferably equal to or greater than 0.9 degree. When the excessive maximum value Afmax is achieved, the outer diameter of the tip member is apt to be large. In this case, the weight of a hosel portion may be increased to excessively bias the center of gravity of the head toward a heel. In this respect, the maximum value Afmax is preferably equal to or less than 1.5 degrees, more preferably equal to or less than 1.3 degrees, and still more preferably equal to or less than 1.1 degrees.

The minimum value Cfmin and the maximum value Cfmax of the adjustment distance of the hook angle at the circumferential relative position C are not restricted. When the adjustment distance is excessively small, it may be actually difficult to adjust the adjustment distance. In this respect, the minimum value Cfmin is preferably equal to or greater than 0.5 degree, more preferably equal to or greater than 0.7 degree, and still more preferably equal to or greater than 0.9 degree. When the excessive maximum value Cfmax is achieved, the outer diameter of the tip member is apt to be large. In this case, the weight of a hosel portion may be increased to excessively bias the center of gravity of the head toward a heel. In this respect, the maximum value Cfmax is preferably equal to or less than 1.5 degrees, more preferably equal to or less than 1.3 degrees, and still more preferably equal to or less than 1.1 degrees.

The minimum value Armin and the maximum value Armax of the adjustment distance of the loft angle at the circumferential relative position A are not restricted. When the adjustment distance is excessively small, it may be actually difficult to adjust the adjustment distance. In this respect, the minimum value Armin is preferably equal to or greater than 0.2 degree, and more preferably equal to or greater than 0.3 degree. When the excessive maximum value Armax is achieved, the outer diameter of the tip member is apt to be large. In this case, the weight of a hosel portion may be increased to excessively bias the center of gravity of the head toward a heel. In this respect, the maximum value Armax of the adjustment distance of the loft is preferably equal to or less than 0.8 degree, more preferably equal to or less than 0.7 degree, and still more preferably equal to or less than 0.6 degree.

The minimum value Crmin and the maximum value Crmax of the adjustment distance of the loft angle at the circumferential relative position C are not restricted. When the adjustment distance is excessively small, it may be actually difficult to adjust the adjustment distance. In this respect, the minimum value Crmin is preferably equal to or greater than 0.2 degree, and more preferably equal to or greater than 0.3 degree. When the excessive maximum value Crmax is achieved, the outer diameter of the tip member is apt to be large. In this case, the weight of a hosel portion may be increased to excessively bias the center of gravity of the head toward a heel. In this respect, the maximum value Crmax of the adjustment distance of the loft is preferably equal to or less than 0.8 degree, more preferably equal to or less than 0.7 degree, and still more preferably equal to or less than 0.6 degree.

The conformation of the engagement of the shaft side engaging part and the head side engaging part is not restricted. In short, the circumferential relative positions A of desired number may be secured at desired positions. Therefore, the conformation of the engagement of the shaft side engaging part and the head side engaging part is not restricted to the embodiment.

The conformation of the engagement of the second portion and the second engaging part is not restricted. In short, the circumferential relative positions A of desired number may be secured at desired positions. Therefore, the conformation of the engagement of the second portion and the second engaging part is not restricted to the embodiment.

When the second portion and the second engaging part have rotational symmetry, other conformations are also possible. For example, a regular polygon is exemplified as the section shapes of the second engaging part and the second portion. As in the first embodiment, the second portion and the second engaging part may have M-fold rotational symmetry. At least one of the second portion and the second engaging part may not have M-fold rotational symmetry.

The conformation of the engagement of the first portion and the first engaging part is not restricted. In short, the circumferential relative positions A of desired number may be secured at desired positions. Therefore, the conformation of the engagement of the first portion and the first engaging part is not restricted to the embodiment.

In the first embodiment, the first engaging part 42 and the second engaging part 44 are provided as the shaft side engaging part 38. The first portion 50 and the second portion 52 are provided as the head side engaging part 48. The first embodiment is not restricted thereto. In short, the circumferential relative positions A of desired number may be secured at desired positions. For example, in the first embodiment, the second engaging part 44 and the second portion 52 may not exist. That is, the first embodiment enables a conformation in which the shaft side engaging part 38 is only the first engaging part 42 and the head side engaging part 48 is only the first portion 50.

In the first embodiment, the convex part t1 as the first engaging part 42 is provided at only one place in the circumferential direction. However, other conformations are also possible. For example, in the first engaging part 42, two convex parts t1 may be provided at every 180 degrees in the circumferential direction. In this case, the same circumferential relative positions A as those of the first embodiment can be achieved by the engagement of the convex parts t1 and the first portion 50.

In the third, fourth, and fifth embodiments, the shaft side engaging part and the head side engaging part have N-fold rotation symmetry. However, the embodiments are not restricted thereto. In short, the N kinds of circumferential relative positions C may be secured.

The inclination angle θ1 is not restricted. In respect of increasing an adjustment width of specification, the angle θ1 is preferably equal to or greater than 0.5 degree, more preferably equal to or greater than 0.7 degree, and still more preferably equal to or greater than 0.9 degree. When the excessive angle θ1 is achieved, the outer diameter of the tip member is apt to be large. In this case, the weight of a hosel portion may be increased to excessively bias the center of gravity of the head toward a heel. In this respect, the angle θ1 is preferably equal to or less than 1.5 degrees, more preferably equal to or less than 1.3 degrees, and still more preferably equal to or less than 1.1 degrees.

The difference (Fmax−Fmin) between the maximum value Fmax and the minimum value Fmin of the hook angle at the circumferential relative position A is not restricted. In respect of securing the adjustment width, the difference (Fmax−Fmin) at the circumferential relative position A is preferably equal to or greater than 2.0 degrees, more preferably equal to or greater than 2.5 degrees, and still more preferably equal to or greater than 3.0 degrees. When the excessive difference (Fmax−Fmin) is achieved, the outer diameter of the tip member is apt to be large. In this case, the weight of a hosel portion may be increased to excessively bias the center of gravity of the head toward a heel. In this respect, the difference (Fmax−Fmin) at the circumferential relative position A is preferably equal to or less than 5.0 degrees, more preferably equal to or less than 4.5 degrees, and still more preferably equal to or less than 4.0 degrees.

The difference (Fmax−Fmin) between the maximum value Fmax and the minimum value Fmin of the hook angle at the circumferential relative position C is not restricted. In respect of securing the adjustment width, the difference (Fmax−Fmin) at the circumferential relative position C is preferably equal to or greater than 2.0 degrees, more preferably equal to or greater than 2.5 degrees, and still more preferably equal to or greater than 3.0 degrees. When the excessive difference (Fmax−Fmin) is achieved, the outer diameter of the tip member is apt to be large. In this case, the weight of a hosel portion may be increased to excessively bias the center of gravity of the head toward a heel. In this respect, the difference (Fmax−Fmin) at the circumferential relative position C is preferably equal to or less than 5.0 degrees, more preferably equal to or less than 4.5 degrees, and still more preferably equal to or less than 4.0 degrees.

The indication sh may be applied to the shaft or the grip in addition to the tip member. The conformation of the indication sh can be made to be the same as that of the tip member. All the descriptions of the indication sh to the above-mentioned tip member can be also applied to the indication sh of the shaft and the grip. The position of the indication sh is not restricted. In respects of the easiness and the visibility of the indication, the indication sh is preferably applied to not the grip but the shaft. When the indication sh is applied to the shaft, the indication sh is preferably located on the grip side of the shaft. The golf players can easily confirm the adjusted position using the indication sh of the shaft. The golf players can easily confirm the indication sh easily in addressing. The indication sh of the shaft is notated by methods such as printing, coating, and sealing. In respect of indication accuracy, the indication sh is preferably applied to the shaft after the tip member is bonded. In this case, the indication sh of the tip member can be easily and correctly conformed to the indication sh of the shaft.

A material of the head body is not restricted. As the preferable material, a titanium alloy, stainless steel, an aluminium alloy, a magnesium alloy, CFRP (carbon fiber reinforced plastic), and a combination thereof are exemplified. A manufacturing method of the head body is not restricted. As the manufacturing method, forging, casting, pressing, and a combination thereof are exemplified. The head body may be obtained by combining a plurality of materials. The head body may be obtained by joining a head body produced by casting and a face part produced by forging or pressing.

A structure of the head body is not restricted. The head may be integrally molded as a whole. The head may be obtained by joining a plurality of members.

A material of the shaft is not restricted. As the material of the shaft, CFRP (carbon fiber reinforced plastic) and a metal are exemplified. A so-called carbon shaft and steel shaft can be suitably used. A structure of the shaft is not restricted.

A material of the tip member is not restricted. As the preferable material, a titanium alloy, stainless steel, an aluminium alloy, a magnesium alloy, and a resin are exemplified. It is preferable that the resin has excellent mechanical strength. For example, the resin is preferably a resin referred to as an engineering plastic or a super-engineering plastic. As described above, the engaging member may be integrally molded with the head body. In respect of a balance between strength and lightweight, for example, the aluminium alloy and the titanium alloy are more suitable.

A material of the engaging member is not restricted. As the preferable material, a titanium alloy, stainless steel, an aluminium alloy, a magnesium alloy, and a resin are exemplified. It is preferable that the resin has excellent mechanical strength. For example, the resin is preferably a resin referred to as an engineering plastic or a super-engineering plastic. As described above, the engaging member may be integrally molded with the head body.

A material of the screw is not restricted. As the preferable material, a titanium alloy, stainless steel, an aluminium alloy, a magnesium alloy, or the like are exemplified.

The loft angle, the lie angle, and the hook angle can be measured by a known measuring device. As an example of the measuring device, a golf club head gauge manufactured by Sheng Feng Iron Enterprise Co. is exemplified. The values of the loft angle, the lie angle, and the hook angle are usually described in a product catalog. The loft angle is a real loft angle.

EXAMPLES

Hereinafter, the effects of the present invention will be clarified by examples. However, the present invention should not be interpreted in a limited way based on the description of the examples.

Example 1

A golf club was produced in a same manner as in the golf club 2 except that a head body containing a portion corresponding to an engaging member 16 was integrally molded without using the engaging member 16. The head body was obtained by casting. A cast first member and a cast second member were welded together to obtain a head body. A material of the head body was Ti-6Al-4V. A weight of the head body was 180 g. A material of a tip member was an aluminium alloy. A weight of the tip member was 8.5 g. The angle θ1 was set to 1.0 degree. A ferrule was driven to a carbon shaft. A tip part of the shaft and the tip member were then bonded to each other. A urethane bonding agent ("Esplen" (trade name) manufactured by Touritsu Kasei Industries, Ltd.) was used for the bond. A screw member was inserted from a sole side, and the screw member and the tip member were engaged in a screwing manner to obtain a golf club. A material of the screw member was Ti-6Al-4V. A weight of the screw member was 1.0 g.

Specifications at circumferential relative positions of the example 1 were described in Table 1.

Comparative Example

Figure 25:
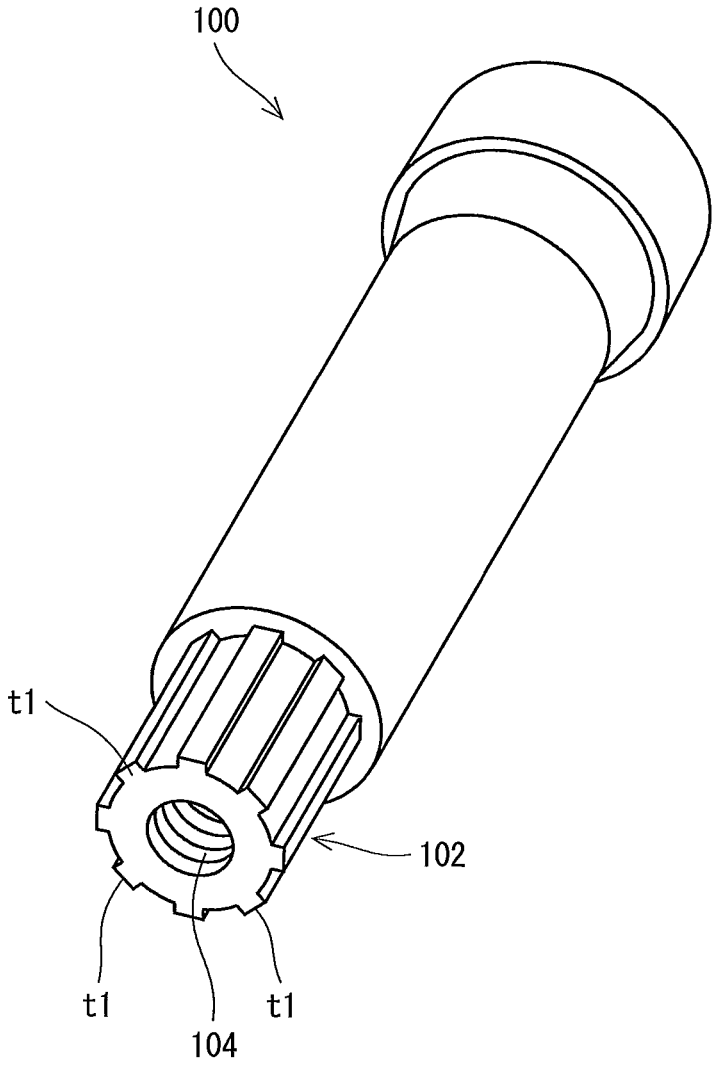
FIG. 25 is a perspective view of a tip member according to a comparative example.
Figure 26:
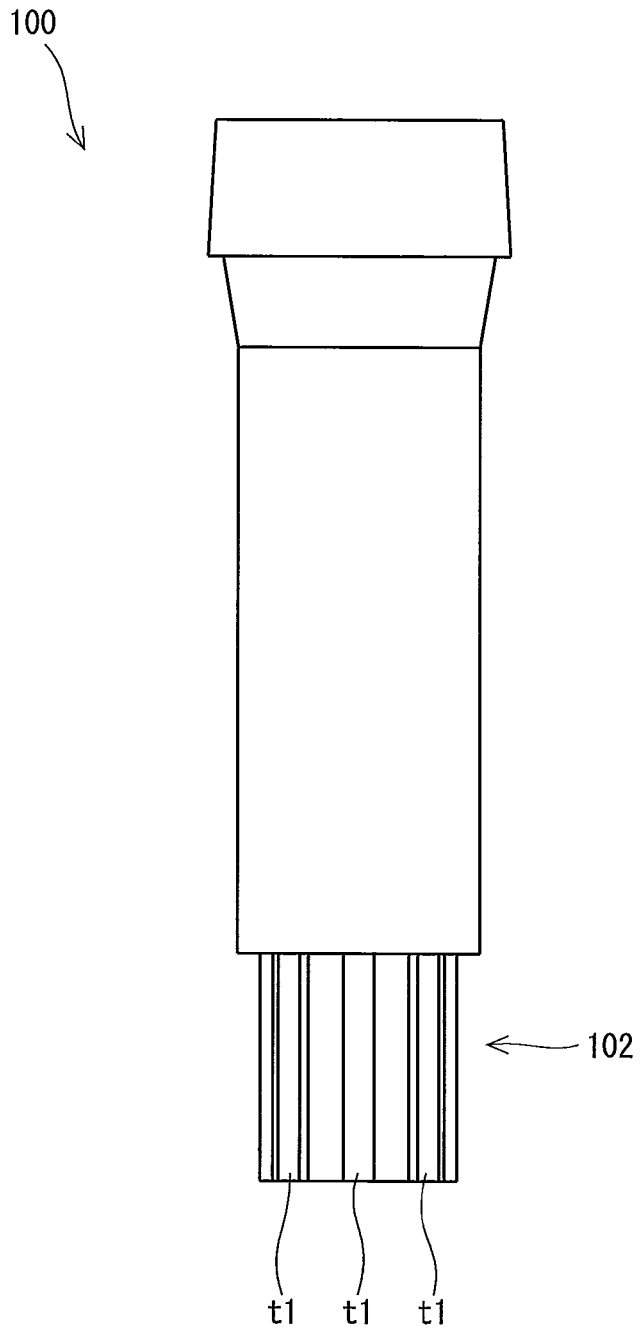
FIG. 26 is a side view of the tip member of FIG. 25.
Figure 27:
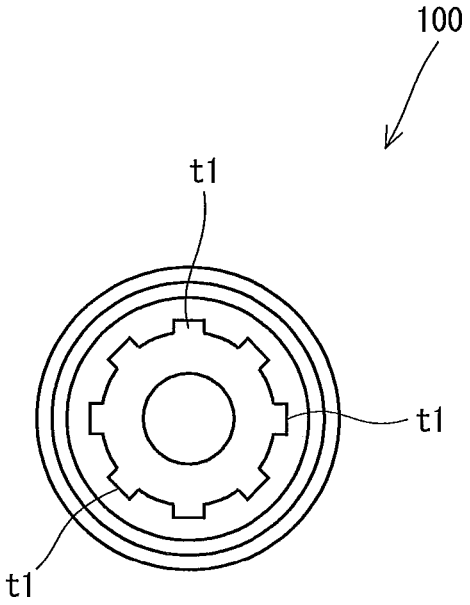
FIG. 27 is a bottom view of the tip member of FIG. 25.

FIG. 25 is a perspective view of a tip member 100 according to a comparative example. FIG. 26 is a side view of the tip member 100. FIG. 27 is a bottom view of the tip member 100.

The tip member 100 has a shaft side engaging part 102, a shaft hole (not shown), and a screw hole 104. The shaft side engaging part 102 is formed by eight convex parts t1 equally distributed in a circumferential direction.

A head side engaging part capable of being engaged with the shaft side engaging part 102 of the tip member 100 at eight kinds of circumferential relative positions was provided on the head body according to the comparative example. The head side engaging part has concave parts r1 formed on the inner surface of a hole and equally distributed at eight places in a circumferential direction. The angle θ1 was set to 1.0 degree.

In a golf club (illustration is omitted) of the comparative example, fixable circumferential relative positions are eight kinds. According to the comparative example, the shaft side engaging part 102 can be fixed at the eight kinds of circumferential relative positions between the shaft side engaging part 102 and the head side engaging part. That is, in the comparative example, the eight kinds of fixable circumferential relative positions are all positions of every 45 degrees. That is, the circumferential relative positions are 0 degree, 45 degrees, 90 degrees, 135 degrees, 180 degrees, 225 degrees, 270 degrees, and 315 degrees.

Specifications at circumferential relative positions of the comparative example were described in Table 2.

As was apparent from Tables 1 and 2, the adjustment distance of the hook angle and the loft angle was equalized in the example 1 as compared with the comparative example.

Figure 28:
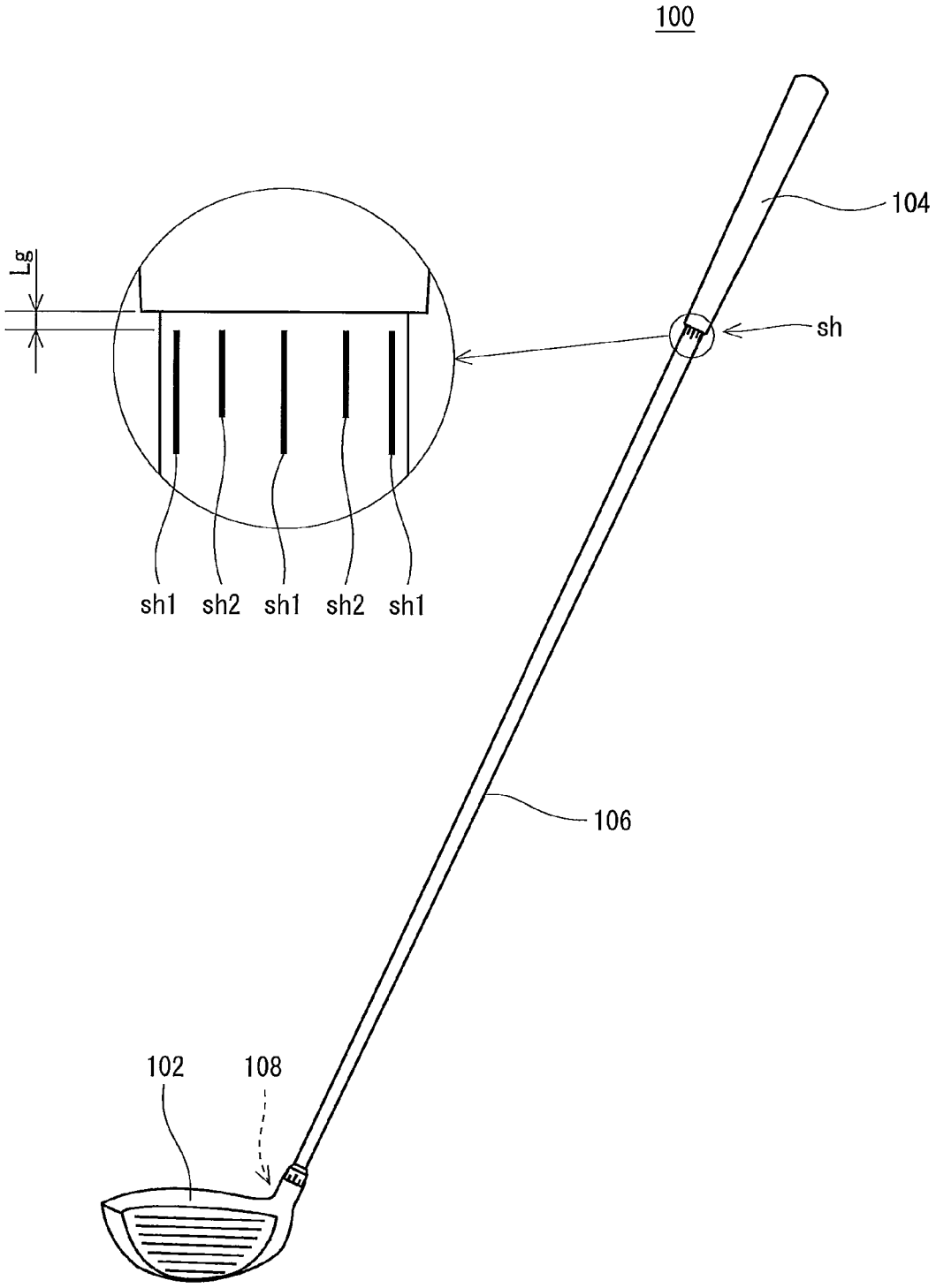
FIG. 28 is a diagram showing an example of a golf club having a shaft on which the same indication sh as that of the tip member is provided.

FIG. 28 shows a golf club 100 of example 2. The club 100 has a head 102, a grip 104, a shaft 106 and a tip member 108. The tip member 108 is the same as the above-mentioned tip member 70.

An indication sh is provided on the shaft 106. The constitution of the indication sh is the same as that of the indication sh applied to the tip member 108. The indication sh of the shaft 106 is applied to a position near the grip 104. Golf players easily confirm the indication sh applied to the position near the grip. In this respect, a distance Lg (see FIG. 28) between the indication sh of the shaft 106 and the tip of the grip is preferably equal to or less than 200 mm, and more preferably equal to or less than 100 mm.

The invention described above can be applied to all golf clubs such as a wood type, utility type, hybrid type, iron type, and putter type golf clubs.

The description hereinabove is merely for an illustrative example, and various modifications can be made in the scope not to depart from the principles of the present invention.

What is claimed is:

1. A golf club comprising: a head; a shaft; a tip member; an indication; and a screw member, wherein the tip member has a shaft hole and a screw hole;

the shaft is inserted into the shaft hole of the tip member, and a tip part of the shaft is fixed to the shaft hole;

an axis line s1 of the shaft is inclined to an axis line z1 of the tip member;

the head has a head hole into which the tip member is inserted, a head side engaging part capable of being engaged with the tip member inserted into the head hole, and a through hole into which the screw member can be inserted;

the tip member has a shaft side engaging part capable of being engaged with the head side engaging part;

the head side engaging part and the shaft side engaging part are engaged with each other so that relative rotation of the head and the tip member is regulated;

coming off of the tip member from the head is regulated by screw connection of the screw member inserted into the through hole and the screw hole;

circumferential relative positions A in which the head side engaging part and the shaft side engaging part can be engaged with each other are N kinds;

the N kinds of circumferential relative positions A can adjust a loft angle, a lie angle, or a hook angle;

the indication has a key indication and a non-key indication;

the key indication corresponding to X kinds (X is an integer of less than N) of circumferential relative positions C, of the N kinds of circumferential relative positions A is provided; and the circumferential relative positions C can equalize adjustment distance of the loft angle, the lie angle, or the hook angle as compared with circumferential relative positions D in being equally divided into X pieces in a circumferential direction.

2. The golf club according to claim 1, wherein when a maximum value of the hook angle is defined as Fmax; a minimum value of the hook angle is defined as Fmin; and a value calculated by an expression [(Fmax+Fmin)/2] is defined as Fmid, a circumferential relative position enabling adjustment to a hook angle Fa satisfying the following expression (1), and a circumferential relative position enabling adjustment to a hook angle Fb satisfying the following expression (2) exist in the circumferential relative positions C:

$$Fmid+(Fmax-Fmid)\times 0.4 \leq Fa \leq Fmid+(Fmax-Fmid)\times 0.6 \quad (1); \text{ and}$$

$$Fmin+(Fmid-Fmin)\times 0.4 \leq Fb \leq Fmin+(Fmid-Fmin)\times 0.6 \quad (2).$$

3. The golf club according to claim 1, wherein a maximum value of the adjustment distance of the hook angle based on the key indication is equal to or less than 1.5 degrees.

* * * * *